US009250576B2

(12) United States Patent
Kawaguchi et al.

(10) Patent No.: US 9,250,576 B2
(45) Date of Patent: Feb. 2, 2016

(54) IMAGE FORMING APPARATUS

(71) Applicant: CANON KABUSHIKI KAISHA, Tokyo (JP)

(72) Inventors: Yuji Kawaguchi, Tokyo (JP); Shinji Katagiri, Yokohama (JP); Masaru Ohno, Ebina (JP); Satoshi Takami, Yokohama (JP); Yoshikuni Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/520,675

(22) Filed: Oct. 22, 2014

(65) Prior Publication Data

US 2015/0037075 A1 Feb. 5, 2015

Related U.S. Application Data

(63) Continuation of application No. 14/031,540, filed on Sep. 19, 2013, now Pat. No. 8,909,111, which is a continuation of application No. PCT/JP2013/060026, filed on Apr. 2, 2013.

(30) Foreign Application Priority Data

Apr. 4, 2012 (JP) ..... 2012-085547
Apr. 1, 2013 (JP) ..... 2013-076426

(51) Int. Cl.
*G03G 15/16* (2006.01)
*G03G 15/01* (2006.01)

(52) U.S. Cl.
CPC ..... *G03G 15/1615* (2013.01); *G03G 15/0131* (2013.01); *G03G 15/162* (2013.01); *G03G 15/1625* (2013.01); *G03G 2215/00059* (2013.01); *G03G 2215/0132* (2013.01); *G03G 2215/1623* (2013.01)

(58) Field of Classification Search
CPC ..... G03G 15/0131; G03G 15/162; G03G 15/1625; G03G 2215/00059; G03G 2215/1623
USPC ..... 399/302, 308
See application file for complete search history.

(56) References Cited

U.S. PATENT DOCUMENTS

| | | | | |
|---|---|---|---|---|
| 8,014,708 | B2 * | 9/2011 | Sawai | 399/302 |
| 2007/0217832 | A1 * | 9/2007 | Oyama et al. | 399/302 |
| 2007/0237553 | A1 * | 10/2007 | Namba | 399/302 |
| 2013/0188980 | A1 * | 7/2013 | Ito | G03G 15/162 399/88 |
| 2013/0188981 | A1 * | 7/2013 | Horiguchi | G03G 15/1605 399/88 |
| 2013/0195519 | A1 * | 8/2013 | Ito | G03G 15/162 399/314 |
| 2013/0259506 | A1 * | 10/2013 | Katagiri | G03G 15/1675 399/66 |
| 2013/0259543 | A1 * | 10/2013 | Katagiri | G03G 15/5004 399/302 |
| 2013/0266336 | A1 * | 10/2013 | Maeda | G03G 15/1605 399/90 |

FOREIGN PATENT DOCUMENTS

JP 2001228722 A * 8/2001

* cited by examiner

*Primary Examiner* — Ryan Walsh
(74) *Attorney, Agent, or Firm* — Canon USA Inc. IP Division

(57) ABSTRACT

It has been difficult to ensure satisfactory secondary transfer performance while ensuring satisfactory primary transfer performance by passing a current in the circumferential direction of an intermediate transfer belt from a current supply member.

To satisfy a relationship of Rv>Rs, where Rv is resistance in the thickness direction of an intermediate transfer belt and Rs is resistance in the circumferential direction of the intermediate transfer belt over the distance between an image carrier located most upstream and an image carrier located most downstream in the movement direction of the intermediate transfer belt.

14 Claims, 18 Drawing Sheets

IMAGE FORMING APPARATUS

CROSS-REFERENCE TO RELATED APPLICATIONS

The present application is a continuation of U.S. patent application Ser. No. 14/031,540, filed on Sep. 19, 2013, which is a by-pass continuation of International Patent Application No. PCT/JP2013/060026, filed Apr. 2, 2013, which claims the benefit of Japanese Patent Applications No. 2012-085547, filed Apr. 4, 2012 and No. 2013-076426, filed Apr. 1, 2013, all of which are hereby incorporated by reference herein in their entirety.

TECHNICAL FIELD

The present invention relates to an electrophotographic image forming apparatus, such as a copying machine or a printer.

BACKGROUND ART

An image forming apparatus that includes an intermediate transfer member is a hitherto known example of an electrophotographic image forming apparatus. In an existing image forming apparatus, a voltage is applied from a voltage power supply to a primary transfer member arranged opposite a photosensitive drum with an intermediate transfer member interposed therebetween, and a primary transfer potential is thereby generated at a primary transfer portion of the intermediate transfer member which comes into contact with the photosensitive drum. Then, a toner image formed on the surface of the photosensitive drum serving as an image carrier is primary-transferred onto the intermediate transfer member by a potential difference produced between the photosensitive drum and the intermediate transfer member (primary transfer process). Subsequently, for each color toner, this primary transfer process is repeatedly performed, and toner images of a plurality of colors are formed on a surface of the intermediate transfer member. Then, as a secondary transfer process, the toner images of the plurality of colors formed on the surface of the intermediate transfer member are secondary-transferred in one go onto a surface of a recording material, such as paper, by applying a voltage to a secondary transfer member. The toner images transferred in one go are subsequently fixed onto the recording material by a fixing unit.

PTL 1 discloses a structure in which a belt is used as an intermediate transfer member (hereinafter referred to as an intermediate transfer belt), a transfer power supply dedicated to primary transfer is connected to a stretching member or a primary transfer member that stretches an inner periphery of the intermediate transfer belt, and primary transfer is performed by passing a current in the circumferential direction of the intermediate transfer belt.

Here, the circumferential direction of the intermediate transfer belt is the direction of rotational movement of the intermediate transfer belt. PTL 1 discloses a structure in which primary transfer potentials are produced at primary transfer portions by divided voltages generated when a current supplied from a member (the stretching member or the primary transfer member) to which the power supply is connected flows in the circumferential direction of the intermediate transfer belt.

CITATION LIST

Patent Literature

PTL 1: Japanese Patent Laid-Open No. 2001-175092

However, in the structure in PTL 1 in which primary transfer is performed by passing a current in the circumferential direction of the intermediate transfer belt, a primary transfer potential at each primary transfer portion of image forming stations is significantly affected by the magnitude of the resistance of the intermediate transfer belt and the distance from a current supply member.

Specifically, the primary transfer potential decreases as the distance from the current supply member to each image forming station increases, so that a significant potential difference between the primary transfer potential of the image forming station near to the current supply member and the primary transfer potential of the image forming station far away from the current supply member may occur. If an appropriate primary transfer potential is not maintained at each image forming station, it is difficult to transfer a necessary amount of toner onto the intermediate transfer belt, thereby resulting in a transfer failure, such as a density failure, in an image fixed on a recording material.

In order to reduce the influence of a voltage drop due to such resistance of the intermediate transfer belt, reducing the resistance of the intermediate transfer belt so as to facilitate the flow of a desired current to a photosensitive drum of each image forming station is considered.

However, although a desired potential may be maintained at each primary transfer portion when the resistance of the intermediate transfer belt is reduced, reduction of the resistance affects the secondary transfer performance. Specifically, reduction of the resistance of the intermediate transfer belt increases the resistance difference between toner and the intermediate transfer belt. In the case where the resistance difference between toner and the intermediate transfer belt becomes large, for example, when an isolated toner image illustrated in FIG. 9A is transferred onto the intermediate transfer belt, a transfer failure occurs. Hereinafter, a transfer failure of an isolated toner image is referred to as a "patch fault". Here, as illustrated in FIG. 9B, a patch fault is a phenomenon in which, because the resistance of a non-toner image region is lower than that of a toner image region, a transfer current selectively flows to the non-toner image region and it is thereby difficult to secondary-transfer the isolated toner image onto the recording material. This phenomenon is evident in a high-temperature and high-humidity environment in which the resistance of a recording material, such as paper, decreases.

In view of the above-described circumstances, the present invention provides an image forming apparatus that ensures satisfactory secondary transfer performance while ensuring satisfactory primary transfer performance.

SUMMARY OF INVENTION

In order to solve the above-described drawback, the present invention provides an image forming apparatus having the following structure. The image forming apparatus includes a plurality of image carriers which carry toner images, an intermediate transfer belt onto which the toner images are primary-transferred from the image carriers and which is movable and has conductivity, a plurality of stretching members which stretch the intermediate transfer belt, and a current supply member which comes into contact with the intermediate transfer belt and supplies a current to the intermediate transfer belt, and the image forming apparatus performs primary transfer by a current being passed from the current supply member to the image carriers through the intermediate transfer belt. In the image forming apparatus, a relationship between Rv and Rs is such that Rv is larger than Rs, where Rv is resistance in a thickness direction of the intermediate transfer belt and Rs is resistance in a circumferential direction of the intermediate transfer belt over a distance between an image carrier located most upstream and an image carrier located most downstream in a movement direction of the intermediate transfer belt.

Further features of the present invention will become apparent from the following description of exemplary embodiments with reference to the attached drawings.

DESCRIPTION OF EMBODIMENTS

Desirable embodiments of the present invention will be exemplarily described in detail below with reference to the drawings. Note that, for example, the dimensions, materials, shapes, and relative positions of components described in the following embodiments are to be appropriately changed in accordance with the structure of an apparatus to which the present invention is applied or various conditions. Hence, the scope of the present invention is not limited to them unless an especially specific description is given.

First Embodiment

Figure 1:
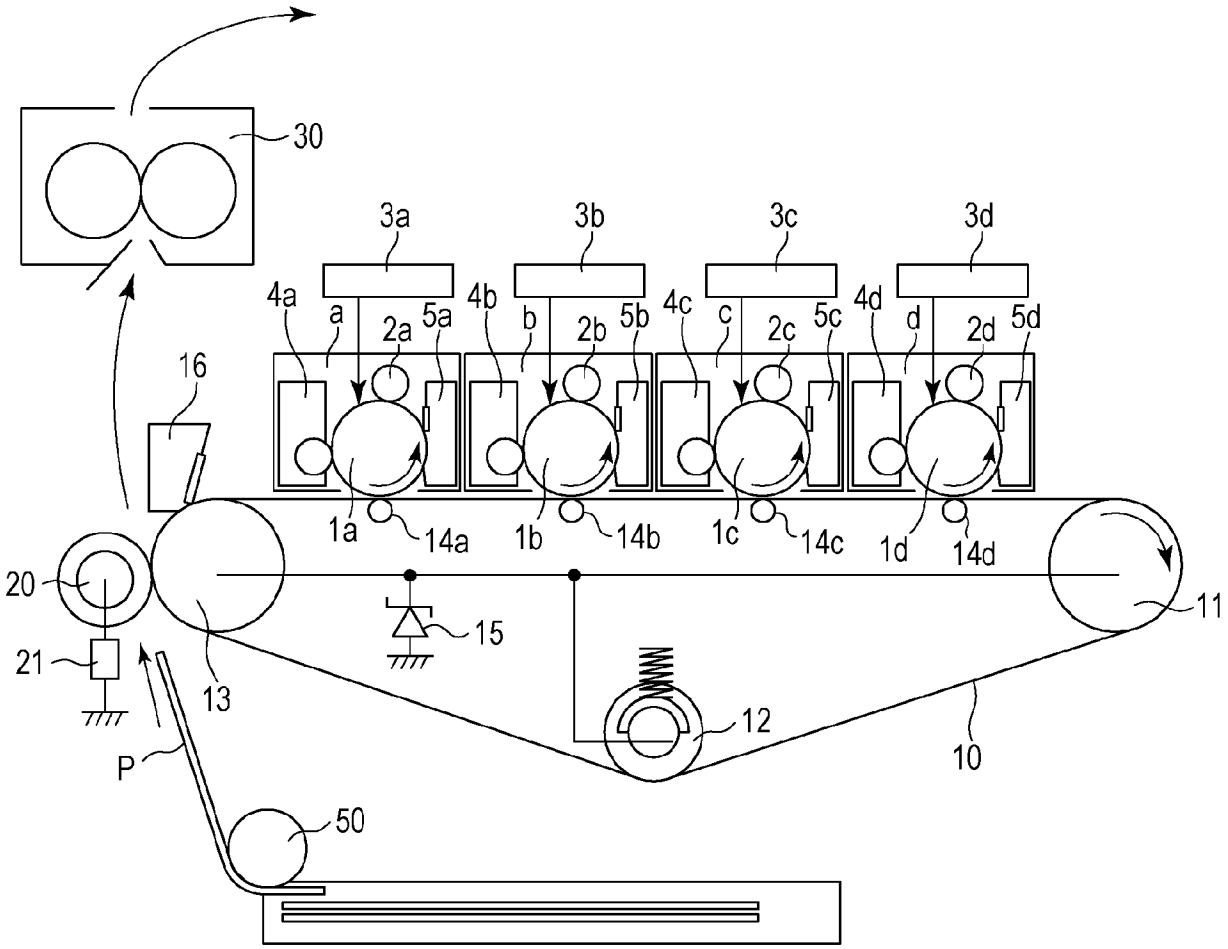
FIG. 1 illustrates an image forming apparatus according to a first embodiment.

FIG. 1 is a schematic view illustrating an example of a color image forming apparatus. The structure of an image forming apparatus according to this embodiment and the operation performed by the image forming apparatus will be described by using FIG. 1. The image forming apparatus according to this embodiment is a so-called tandem-type printer that includes image forming stations a to d. A first image forming station a forms a yellow (Y) image, a second image forming station b forms a magenta (M) image, a third image forming station c forms a cyan (C) image, and a fourth image forming station d forms a black (Bk) image. The structures of the image forming stations are the same except for the colors of toners contained therein. The following description will be made by using the first image forming station a.

The first image forming station a includes a drum-shaped electrophotographic photosensitive member (hereinafter referred to as a photosensitive drum) 1*a*, a charging roller 2*a* serving as a charging member, a development unit 4*a*, and a cleaning device 5*a*. The photosensitive drum 1*a* is an image carrier that is driven to rotate at a certain circumferential speed (processing speed) in the direction of an arrow and carries a toner image.

In addition, the development unit 4*a* is a device that contains yellow toner and develops yellow toner onto the photosensitive drum 1*a*. The cleaning device 5*a* is a member that recovers toner adhering to the photosensitive drum 1*a*. In this embodiment, the cleaning device 5*a* includes a cleaning blade, which is a cleaning member disposed in contact with the photosensitive drum 1*a*, and a waste toner box that contains toner recovered by the cleaning blade.

A controller 100 (control unit) receives an image signal, an image forming operation thereby starts, and the photosensitive drum 1*a* is driven to rotate. In the rotational process, the photosensitive drum 1*a* is uniformly charged by the charging roller 2*a* with a certain polarity (negative polarity in this embodiment) so as to have a certain potential, and is exposed to light by an exposure unit 3*a* in accordance with the image signal. Thus, an electrostatic latent image corresponding to a yellow color component image of an intended color image is formed. Subsequently, the electrostatic latent image is developed at a development position by the development unit (yellow development unit) 4*a* and visualized as a yellow toner image. Here, the normal charge polarity of toner contained in the development unit is a negative polarity. In this embodiment, an electrostatic latent image is reversely developed by using the toner charged with the same polarity as the charge polarity of the photosensitive drum charged by the charging roller. However, the present invention is applicable to an electrophotographic apparatus that normally develops an electrostatic latent image by using toner charged with a polarity opposite to the charge polarity of a photosensitive drum.

An intermediate transfer belt 10 is stretched by a plurality of stretching members 11, 12, and 13. The intermediate transfer belt 10 is movable at substantially the same circumferential speed as that of the photosensitive drum 1*a* in the same direction as the movement direction of the photosensitive drum 1*a* at an opposite portion in contact with the photosensitive drum 1*a*. In the process where the yellow toner image formed on the photosensitive drum 1*a* passes through a contact portion (hereinafter referred to as a primary transfer portion) between the photosensitive drum 1*a* and the intermediate transfer belt 10, the yellow toner image is transferred (primary-transferred) onto the intermediate transfer belt 10 by a potential difference produced between the photosensitive drum 1*a* and the intermediate transfer belt 10. Hereinafter, the potential of the intermediate transfer belt 10 that is produced at the primary transfer portion is referred to as a primary transfer potential. The method of producing the primary transfer potential in this embodiment will be described below.

Primary transfer residual toner remaining on the surface of the photosensitive drum 1*a* is cleaned and removed by the cleaning device 5*a* and then is used for a charging and a subsequent image forming process.

Likewise, a magenta (second color) toner image, a cyan (third color) toner image, and a black (fourth color) toner image are respectively formed by the second, third, and fourth image forming stations b, c, and d, and sequentially transferred in a superimposed manner onto the intermediate transfer belt 10, so that a composite color image corresponding to an intended color image is obtained.

In the process where the toner images of the four colors on the intermediate transfer belt 10 pass through a secondary transfer portion formed by the intermediate transfer belt 10 and a secondary transfer roller 20, the toner images of the four colors are transferred (secondary-transferred) in one go onto a surface of a recording material P fed by a paper feeding unit 50. As the secondary transfer roller 20 serving as a secondary transfer member, a roller having an outside diameter of 18 mm formed by covering a nickel-plated steel rod having an outside diameter of 8 mm with a sponge foam member whose volume resistivity and thickness are respectively adjusted to 108 Ω·cm and 5 mm and whose principal constituents are NBR and epichlorohydrin rubber is used. The secondary transfer roller 20 comes into contact with an outer periphery of the intermediate transfer belt 10 with an applied pressure of 50 N and forms the secondary transfer portion. The secondary transfer roller 20 is driven to rotate as the intermediate transfer belt 10 rotates. A secondary transfer voltage of 2500 [V] is applied from a transfer power supply 21 to the secondary transfer roller 20 while the toner on the intermediate transfer belt 10 is being secondary-transferred onto the recording material P, such as paper.

The transfer power supply 21 includes a transformer that generates a voltage, and supplies a secondary transfer voltage to the secondary transfer roller 20. A control unit (not illustrated), such as a controller, controls the voltage output from the transformer so that the secondary transfer voltage is substantially constant. The transfer power supply 21 is capable of applying voltages ranging from 100 [V] to 4000 [V].

Subsequently, the recording material P carrying the toner images of the four colors is introduced into a fixing unit 30, and subjected to heat and pressure. Thus, the four color toners are fused, mixed, and fixed onto the recording material P. Toner remaining on the intermediate transfer belt 10 after secondary transfer is completed is cleaned and removed by a cleaning apparatus 16. A full-color print image is formed by performing the above operation.

Figure 2:
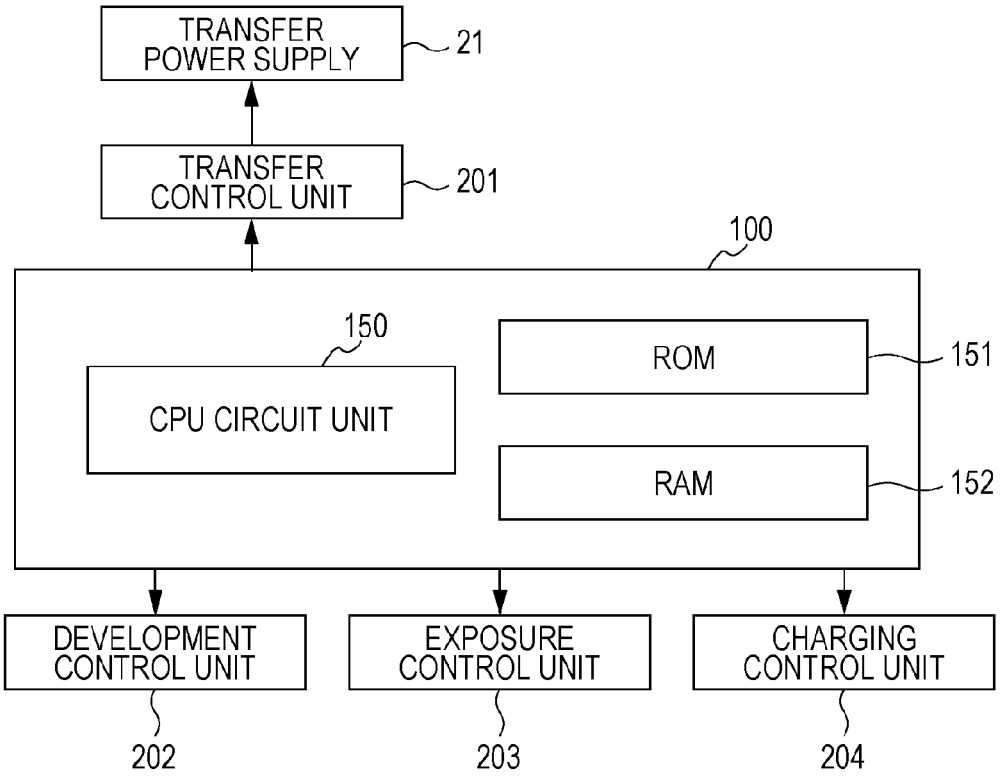
FIG. 2 is a block diagram illustrating control units of the image forming apparatus.

The configuration of the controller 100 that controls the entire image forming apparatus will be described with reference to FIG. 2. As illustrated in FIG. 2, the controller 100 includes a CPU circuit unit 150. The CPU circuit unit 150 has a ROM 151 and a RAM 152. The CPU circuit unit 150 performs centralized control of a transfer control unit 201, a development control unit 202, an exposure control unit 203, and a charging control unit 204 in accordance with a control program stored in the ROM 151. An environment table and a table for handling paper thickness are stored in the ROM 151, and called and used by the CPU circuit unit 150. The RAM 152 temporarily retains control data and also is used as a working area for arithmetic processing involved in control. The transfer control unit 201 controls the transfer power supply 21 and controls a voltage output from the transfer power supply 21 on the basis of a current value detected by a current detection circuit, which is not illustrated. When the controller 100 receives image information and a print instruction from a host computer (not illustrated), the controller 100 controls the control units (development control unit 202, exposure control unit 203, and charging control unit 204) and performs an image forming operation required for a print operation.

The intermediate transfer belt 10 serving as an intermediate transfer member is arranged opposite the image forming stations a to d. The intermediate transfer belt 10 is an endless belt formed by adding a conductive agent to a resin material so as to give conductivity thereto. The intermediate transfer belt 10 is stretched by three stretching members: a driving roller 11, a tension roller 12, and a secondary transfer opposite member 13 which serve as the stretching members. The intermediate transfer belt 10 is stretched by the tension roller 12 with a total tension of 60 N. The intermediate transfer belt 10 is driven to rotate by a driving source (not illustrated) at substantially the same circumferential speed as those of the photosensitive drum 1*a*, and photosensitive drums 1*b*, 1*c*, and 1*d*, in the same direction as the movement directions of the photosensitive drums 1*a*, 1*b*, 1*c*, and 1*d*, at opposite portions in contact with the photosensitive drums 1*a*, 1*b*, 1*c*, and 1*d*. Hereinafter, a surface of the intermediate transfer belt 10 which is present between two of the stretching members (secondary transfer opposite roller 13 and driving roller 11) and onto which toner images are primary-transferred from the photosensitive drums 1*a*, 1*b*, 1*c*, and 1*d* is defined as a primary transfer surface M.

Contact members 14*a*, 14*b*, 14*c*, and 14*d* are arranged at positions corresponding to the photosensitive drums 1*a*, 1*b*, 1*c*, and 1*d* of the image forming stations so as to ensure contact between the photosensitive drums 1*a*, 1*b*, 1*c*, and 1*d* and the intermediate transfer belt 10, and to form primary transfer portions. As the contact members 14*a*, 14*b*, 14*c*, and 14*d*, members having an outside diameter of 12 mm each formed by covering a nickel-plated steel rod having an outside diameter of 6 mm with a sponge foam member whose volume resistivity and thickness are respectively adjusted to 107 ΩK·cm and 3 mm and whose principal constituents are NBR (nitrile butadiene rubber) and epichlorohydrin rubber are used. The contact members 14*a* to 14*d* are disposed in contact with the photosensitive drums 1*a* to 1*d* with an applied pressure of 9.8 N with the intermediate transfer belt 10 interposed therebetween. The contact members 14*a* to 14*d* are driven to rotate as the intermediate transfer belt 10 rotates. The contact members 14*a*, 14*b*, 14*c*, and 14*d* are electrically floating.

As the intermediate transfer belt 10 used in this embodiment, an endless polyimide resin which has a circumferential length of 700 mm and a thickness of 90 μm and which is mixed with carbon as a conductive agent is used. The intermediate transfer belt 10 has electric characteristics of exhibiting electronic conductivity and of having a small variation in resistance value with respect to temperature and humidity in an atmosphere. In this embodiment, a polyimide resin is used as a material of the intermediate transfer belt 10; alternatively, other materials may be used as long as they are thermoplastic resins. For example, materials, such as polyester, polycarbonate, polyarylate, acrylonitrile-butadiene-styrene (ABS) copolymer, polyphenylene sulfide (PPS), and polyvinylidene fluoride (PVdF), and a mixture of two or more of these resin materials may be used. As a conductive agent, conductive metal-oxide fine particles other than carbon may be used.

In this embodiment, each primary transfer potential is produced by a current flowing in the circumferential direction of the intermediate transfer belt 10. When the resistance of the intermediate transfer belt 10 is high, the amount of current that flows in the circumferential direction is small, so that it is difficult to produce a desired primary transfer potential. Now, a method for measuring resistance of the intermediate transfer belt 10 will be described. In this embodiment, resistance in the thickness direction and resistance in the circumferential direction of the intermediate transfer belt 10 are measured by using two types of measuring methods.

Figure 3:
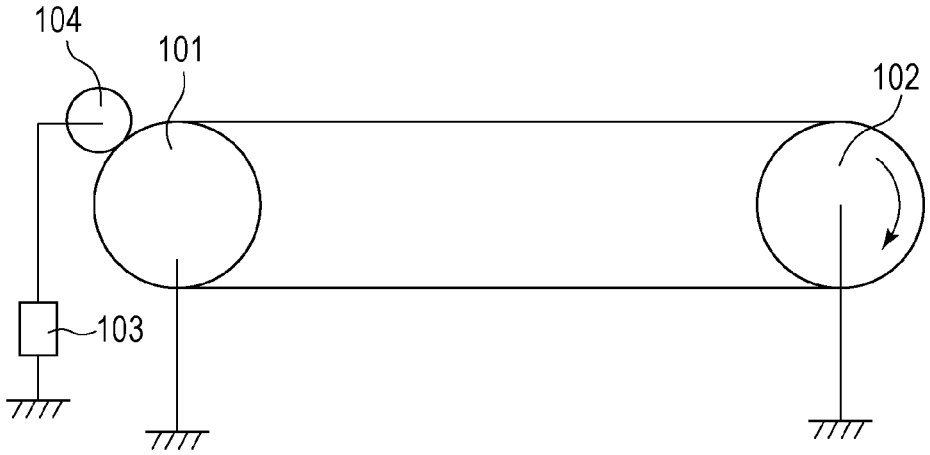
FIG. 3 illustrates a method for measuring resistance in the thickness direction of an intermediate transfer belt.

FIG. 3 illustrates a jig for measuring resistance in the thickness direction of the intermediate transfer belt 10. The intermediate transfer belt 10 to be measured is stretched by an inner roller 101 and a driving roller 102 without slack. A measuring roller 104 is disposed in contact with the inner roller 101 made of metal with an applied pressure of about 4.9 N with the intermediate transfer belt 10 interposed therebetween. The measuring roller 104 is connected to a high-voltage power supply (high-voltage power supply manufactured by TREK, Inc.: Model_610E) 103, and the driving roller 102 is electrically grounded. The surfaces of the measuring roller 104 and the driving roller 102 are covered with conductive rubber which exhibits sufficiently low resistance to the intermediate transfer belt 10. The intermediate transfer belt 10 is caused to rotate at a speed of 100 mm/sec, and the measuring roller 104 is driven to rotate as the intermediate transfer belt 10 rotates.

Next, a measuring method will be described. In the state where the driving roller 102 causes the intermediate transfer belt 10 to rotate at a speed of 100 mm/sec, a constant current Iv is applied to the measuring roller 104 and a voltage Vv is monitored by the high-voltage power supply 103 connected to the measuring roller 104. The constant current Iv is changed and the voltage Vv is monitored, and the resistance Rv (=Vv/Iv) is calculated. In this embodiment, when Rv is measured, constant current control is performed with a current of 10 μA. Here, a constant current value of 10 μA is the amount of current which is passed to the secondary transfer member when secondary transfer is performed and a current value with which secondary transfer performance influenced by the resistance in the thickness direction of the intermediate transfer belt 10 is satisfied. The voltage Vv is monitored twice or more and the Rv derived from the average of the monitoring results is 7.4 log Ω.

Figure 4A:
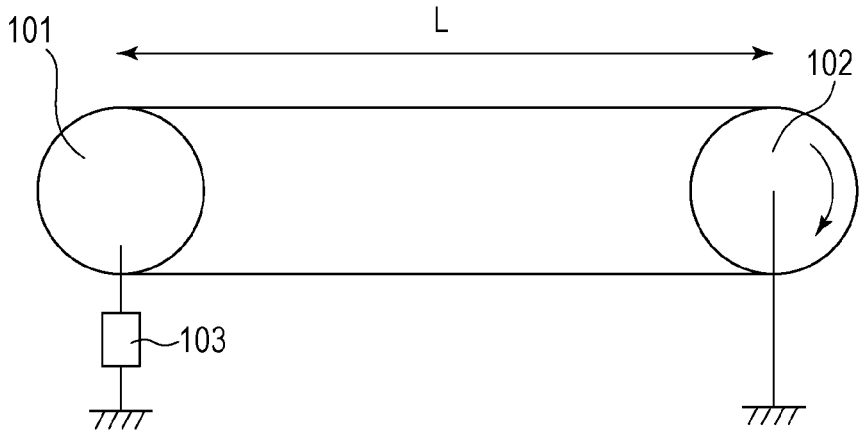
FIGS. 4A and 4B illustrate a method for measuring resistance in the circumferential direction of the intermediate transfer belt.

Resistance in the circumferential direction of the intermediate transfer belt 10 is measured by using a jig for measuring resistance in the circumferential direction illustrated in FIG. 4A. First, the structure of the device will be described. The intermediate transfer belt 10 to be measured is stretched by the inner roller 101 and the driving roller 102 without slack. The inner roller 101 made of metal is connected to the high-voltage power supply (high-voltage power supply manufactured by TREK, Inc.: Model_610E) 103, and the driving roller 102 is grounded. The surface of the driving roller 102 is covered with conductive rubber which exhibits sufficiently low resistance to the intermediate transfer belt 10, and the driving roller 102 rotates to cause the intermediate transfer belt 10 to rotate at a speed of 100 mm/sec.

Figure 4B:
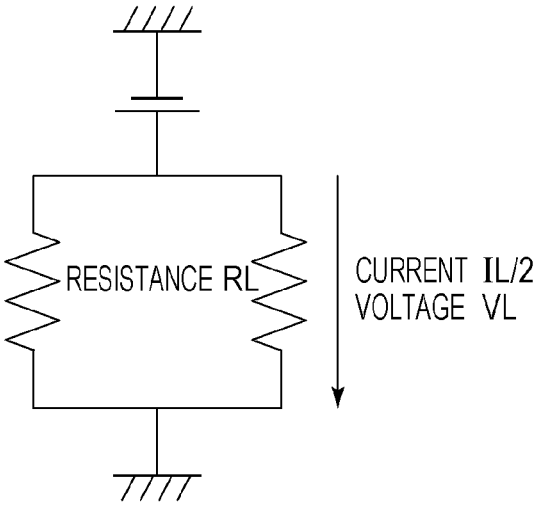

The inner roller 101 is connected to the high-voltage power supply (high-voltage power supply manufactured by TREK, Inc.: Model_610E) 103, the intermediate transfer belt 10 is caused to rotate at a speed of 100 mm/sec, a constant current IL is applied to the inner roller 101, and a voltage VL is monitored by the high-voltage power supply 103. Suppose now that the measuring system illustrated in FIG. 4A is an equivalent circuit illustrated in FIG. 4B. Resistance RL in the circumferential direction of the intermediate transfer belt 10 over the length of a distance L (300 mm in this embodiment) between the inner roller 101 and the driving roller 102 may be calculated by using RL=2VL/IL. In this embodiment, this RL is converted into resistance over a distance S (200 mm in this embodiment) between the photosensitive drum 1*a* of the first image forming station a and the photosensitive drum 1*d* of the fourth image forming station d, and the obtained value is determined as resistance Rs in the circumferential direction. In other words, the resistance Rs in the circumferential direction is resistance in the circumferential direction over the distance between the photosensitive drum 1*a* located most upstream and the photosensitive drum 1*d* located most downstream in the movement direction of the intermediate transfer belt 10.

In this embodiment, when RL is measured, constant current control is performed with a current of 30 μA. Here, a constant current value of 30 μA is a current value with which primary transfer performance influenced by the resistance in the circumferential direction is satisfied and the value of current which flows to the photosensitive drums 1*a* to 1*d* of the first to fourth image forming stations a to d. The voltage VL is monitored twice or more and the Rs derived from the average of the monitoring results is 7.0 log Ω.

Thus, in this embodiment, as the intermediate transfer belt 10, a conductive belt having anisotropy for the resistance in the circumferential direction and the resistance in the thickness direction is employed with consideration of the primary transfer performance and the secondary transfer performance, respectively.

The method of producing a primary transfer potential for performing primary transfer according to this embodiment will be described in detail below. In the structure according to this embodiment, a secondary transfer power supply 21 serving as the transfer power supply that applies a voltage to the secondary transfer member is used as a power supply for performing primary transfer. That is, the secondary transfer power supply 21 is a common transfer power supply for primary transfer and secondary transfer. Hence, the secondary transfer roller 20 is used as a member that secondary-transfers a toner image from the intermediate transfer belt 10 onto the recording material and also a current supply member that supplies a current to the intermediate transfer belt 10. If the secondary transfer power supply 21 is used as a common transfer power supply for primary transfer and secondary transfer, a transfer power supply dedicated to primary transfer becomes unnecessary, thereby enabling cost reduction.

In this embodiment, in order to stabilize a potential at each primary transfer portion, a voltage-maintaining element 15 is connected to the secondary transfer opposite roller 13. The voltage-maintaining element 15 is a member that maintains the potential of the member (secondary transfer opposite roller 13) connected thereto at a certain potential or higher when a constant current is supplied thereto. In this embodiment, as the voltage-maintaining element 15, a zener diode 15, which is a constant voltage element, is used. Hereinafter, when a voltage is applied in a reverse direction to the zener diode 15, a voltage applied between an anode and a cathode is defined as a zener voltage. In this embodiment, a zener diode whose zener voltage is 200 [V] is used.

Figure 5:
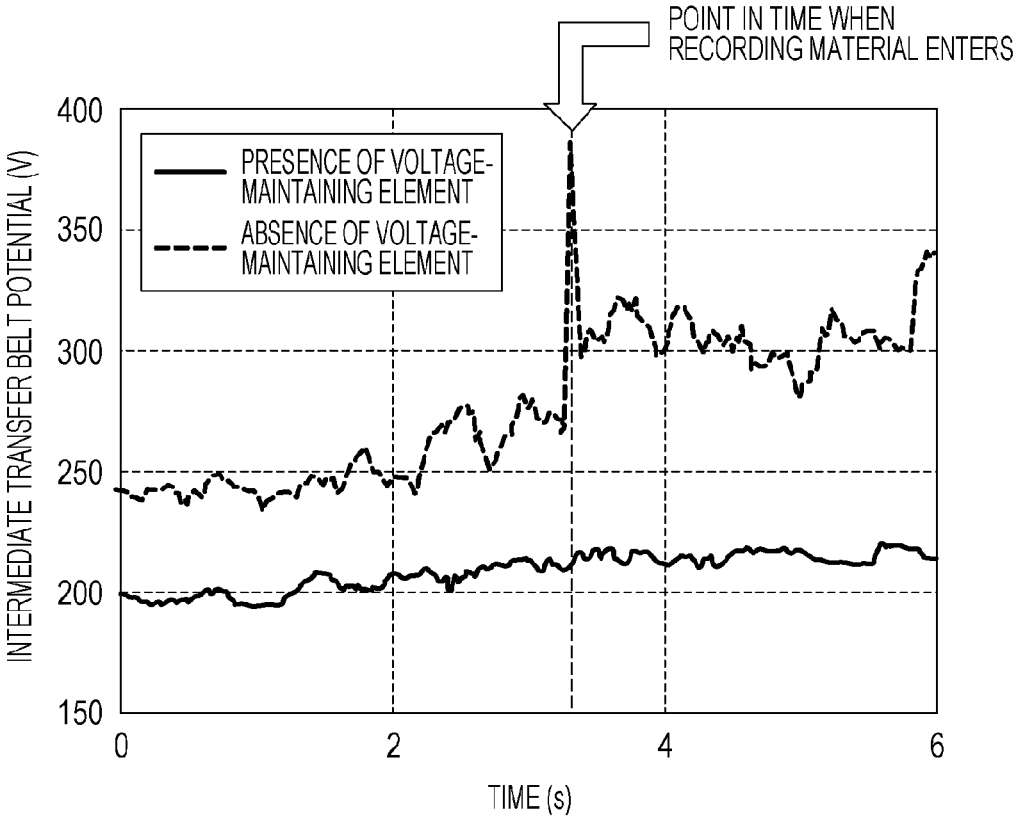
FIG. 5 illustrates changes in potential of the intermediate transfer belt at a point in time when a recording material enters a secondary transfer portion.

The effect of connection of the zener diode 15 to the secondary transfer opposite roller 13 will be described. FIG. 5 illustrates measurements of change in potential at the primary transfer portion of the first image forming station a at around the time when the recording material P is caused to enter the secondary transfer portion. During the secondary transfer process in the structure according to this embodiment, a voltage applied to the intermediate transfer belt 10 is measured. A voltage measurement is made by using a surface-potential measuring device (Model 370) manufactured by TREK, Inc. and a dedicated probe (Model 3800S-2). In FIG. 5, the vertical axis represents potential at the primary transfer portion of the first image forming station a and the horizontal axis represents time course.

A dotted line in FIG. 5 indicates the case where the zener diode 15 is not connected and a solid line in FIG. 5 indicates the case where the zener diode 15 is connected. In the case where the zener diode 15 is connected, because an excess of the current applied from the secondary transfer roller 20 may be passed to the zener diode 15 through the intermediate transfer belt 10 and the secondary transfer opposite roller 13, a surface potential of the intermediate transfer belt 10 may be stabilized at a desired potential of 200 [V]. However, in the case where the zener diode 15 is not connected, because the above-mentioned effect is not obtained, an intermediate transfer belt potential at the primary transfer portion of the first image forming station a sharply changes from at a point in time when the recording material enters the secondary transfer portion.

Thus, connection of the zener diode 15 to the secondary transfer opposite roller 13 enables the primary transfer potential to be maintained constant even if a secondary transfer current is increased when the recording material reaches the secondary transfer portion.

As illustrated in FIG. 1, the zener diode 15, which is the voltage-maintaining element, may also be connected to the driving roller 11 and the tension roller 12, other than the secondary transfer portion, that stretch the intermediate transfer belt 10. Because these are in contact with the intermediate transfer belt 10 with the potentials thereof maintained at a potential close to the primary transfer potential, the primary transfer potential may be more stabilized.

In this embodiment, in order to stabilize an intermediate transfer belt potential, the zener diode 15, which is a constant voltage element, is used as the voltage-maintaining element; alternatively, another constant voltage element (e.g., an element, such as a varistor) may be used as long as the element has a similar effect.

In this embodiment, as the intermediate transfer belt 10 of the above-described image forming apparatus, a belt is used in which the relationship of Rv>Rs is satisfied, where Rv and Rs are respectively the resistance in the thickness direction and the resistance in the circumferential direction of the intermediate transfer belt 10. Here, the resistance in the circumferential direction is resistance in the circumferential direction over the distance between the photosensitive drum 1*a* located most upstream and the photosensitive drum 1*d* located most downstream in the movement direction of the intermediate transfer belt 10.

The belt in which the relationship of Rv>Rs is satisfied allows a current capable of realizing secondary transfer to be passed to a toner patch portion of an image including an isolated patch pattern while a current capable of realizing primary transfer is being passed to the photosensitive drums 1*a* to 1*d* of the image forming stations. Hence, a patch fault may be suppressed.

Hereinafter, verification of the effect was made by using comparative examples. In order to examine the effect of the image forming apparatus according to this embodiment, the image forming apparatus including the intermediate transfer belt 10 whose resistance relationship was changed was used, and the verification of the effect was made. As for this embodiment and the following two comparative examples, surface potentials of the intermediate transfer belt 10 at the primary transfer portions and the primary transfer performance were checked. In addition, transfer currents during secondary transfer were measured and the levels of patch faults were compared. As the material of the intermediate transfer belt 10 used in the comparative examples, a material formed by dispersing carbon black as a conductive agent in a polyimide resin is used. Resistance adjustments are made by adjusting the amount of the carbon black. The two comparative examples used this time will be described below.

First Comparative Example

The resistance relationship of the intermediate transfer belt 10 is Rv<Rs, and the actual resistance values are Rv=7.5 log Ω and Rs=8.9 log Ω.

Second Comparative Example

As in the first comparative example, the resistance relationship of the intermediate transfer belt 10 is Rv<Rs, and the actual resistance values are Rv=6.5 log Ω and Rs=6.8 log Ω.

The resistance values in this embodiment and the above two comparative examples are summarized in Table 1. These values were obtained by using the above-described resistance measuring method. Rv and Rs are results obtained by measuring resistance during application of a constant current of 10 μA and by measuring resistance during application of a constant current of 30 μA, respectively. Table 2 indicates potentials of the intermediate transfer belt 10 at the primary transfer portions and the primary transfer performance in each of this embodiment and the two comparative examples. Table 3 indicates transfer currents during secondary transfer and the levels of the patch faults.

TABLE 1

| | Rv (log Ω) | Rs (log Ω) |
|---|---|---|
| Embodiment 1 | 7.4 | 7.0 |
| Comparative Example 1 | 7.5 | 8.9 |
| Comparative Example 2 | 6.5 | 6.8 |

TABLE 2

| | Intermediate Transfer Belt Potential (V) | | | |
|---|---|---|---|---|
| | Stretching Roller Portion | First Image Forming Station | Fourth Image Forming Station | Primary Transfer Performance |
| Embodiment 1 | 200 | 200 | 195 | ○ |
| Comparative Example 1 | 200 | 40 | 5 | x |
| Comparative Example 2 | 200 | 180 | 150 | ○ |

TABLE 3

| | Δi (μA) | Patch Fault Level |
|---|---|---|
| Embodiment 1 | 38 | ○ |
| Comparative Example 1 | 45 | ○ |
| Comparative Example 2 | 63 | x |

An evaluation method will be described below.

As for the potentials of the intermediate transfer belt 10 at the primary transfer portions indicated in Table 2, a voltage is applied from the transfer power supply 21 to the secondary transfer roller 20 (current supply member), and the amount of current propagating through the intermediate transfer belt 10 is measured. Specifically, potentials immediately below the photosensitive drums 1 in the first image forming station and the fourth image forming station are measured by using the surface-potential measuring device (Model 370) manufactured by TREK, Inc. An evaluation result of the primary transfer performance corresponding to the obtained potentials is also indicated. In order to stabilize a potential, a voltage-maintaining element 15 is connected to a stretching roller 13, which is an opposite roller of the secondary transfer roller 20. Thus, the potential of a stretching roller portion is stabilized at 200 V.

Figure 9A:
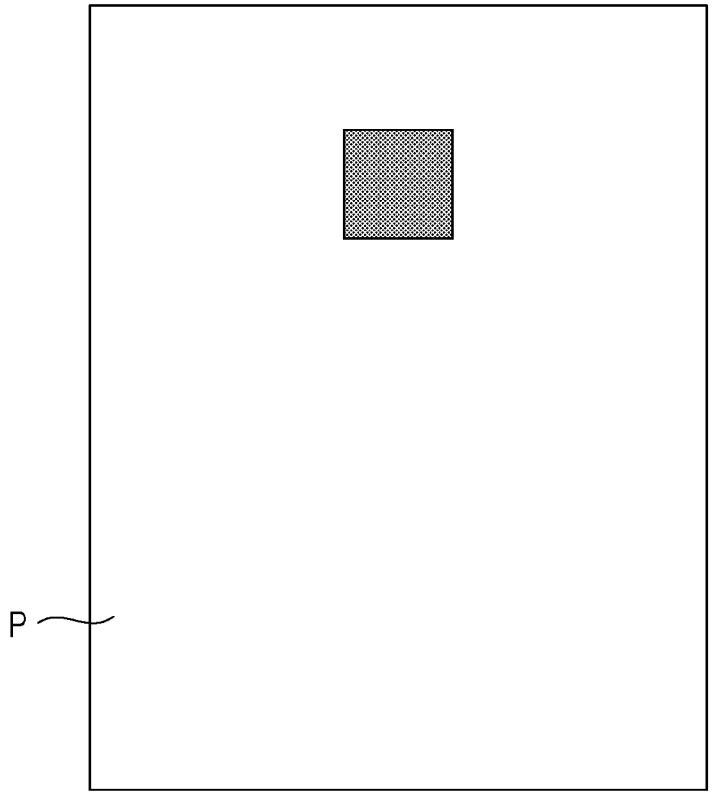
FIG. 9A illustrates an isolated patch pattern whose secondary transfer performance is evaluated and FIG. 9B illustrates an occurrence mechanism of a patch fault.

An evaluation of secondary transfer performance is made by comparing current values of a white portion (paper passing portion) and a black portion (toner portion) which are found when toner is secondary-transferred onto the recording material P. When a constant voltage of 600 V is applied to an isolated patch portion and a white portion which are illustrated in FIG. 9A, currents flowing through these portions are monitored. The fact that a current flowing through the black portion is smaller than a current flowing through the white portion means that a current does not flow to the toner portion and escapes onto the recording material, thereby indicating low secondary transfer performance. That is, the larger the difference (hereinafter referred to as "Δi") between currents at the white portion and the black portion is, the more a patch fault is likely to occur.

In order to suppress a patch fault, it is desirable that Δi be 50 μA or less. In addition to monitoring of currents, the transfer performance capabilities of the isolated patches are determined from images and the levels of the patch faults are compared. An evaluation environment is a high-temperature and high-humidity environment (30° C./85%) in which the resistance of the recording material P becomes low. As the recording material P, Business 4200 paper (basis weight: 75 g/m2) (manufacturer: Xerox Corp.) that has been under high temperature and high humidity for a long time is used.

Next, evaluation results will be described. Because Rs is high in the first comparative example, as indicated in Table 2, a voltage drop occurs before a current reaches the image forming stations, and it is therefore difficult to ensure the potential of the intermediate transfer belt 10. In the first comparative example in which Rs is high, potential differences between the intermediate transfer belt 10 and the photosensitive drums 1 are not produced and it is difficult to desirably perform primary transfer.

On the other hand, in the evaluation of the secondary transfer performance, as indicated in Table 3, Δi may be kept smaller than 50 μA and the occurrence of a patch fault may be suppressed. Because Rv is high in the first comparative example, the secondary transfer performance may be ensured. Ensuring of the secondary transfer performance results from the fact that a current may be passed to the toner portion in the right amount because high Rv may prevent a supply current from flowing through low-resistance paper and escaping onto the intermediate transfer belt 10.

Hence, as for the transfer performance in the first comparative example, the secondary transfer performance may be satisfied because Rv is high; however, the primary transfer performance may not be able to be satisfied because Rs is high. As a result, the resistance relationship of the intermediate transfer belt 10 in the first comparative example may be incapable of satisfying both the primary transfer performance and the secondary transfer performance in the present structure.

Because Rs is low in the second comparative example and a current may therefore be passed in the circumferential direction of the intermediate transfer belt 10, as indicated in Table 2, such a large voltage drop does not occur prior to image forming stations. Hence, in the second comparative example, primary transfer may be performed by potential differences between the intermediate transfer belt 10 and the photosensitive drums 1.

Figure 9B:
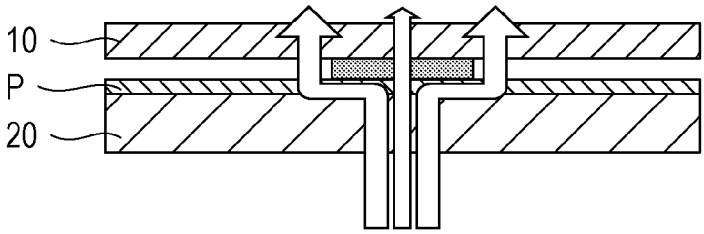

However, in the second comparative example, because Rv is still lower than Rs, the secondary transfer performance may not be able to be satisfied. As indicated in Table 3, Δi becomes larger than 50 μA and a patch fault occurs. As illustrated in FIG. 9B, a supply current flows through low-resistance paper and escapes onto the intermediate transfer belt 10 because Rv is low. Thus, it is difficult to supply a desired current to the toner portion. For this reason, in the second comparative example in which Rv is low, it is difficult to desirably perform secondary transfer.

Hence, as for the transfer performance in the second comparative example, the primary transfer performance may be satisfied because Rs is low; however, the secondary transfer performance may not be able to be satisfied because Rv is still lower than Rs. As a result, the resistance relationship of the intermediate transfer belt 10 in the second comparative example may be incapable of satisfying both the primary transfer performance and the secondary transfer performance in the present structure.

As described above, the results of the first comparative example and the second comparative example indicate that it is difficult to desirably perform primary transfer or secondary transfer when the intermediate transfer belt 10 having the relationship of Rv<Rs is used.

On the other hand, in this embodiment, secondary transfer may desirably be performed while the primary transfer performance is satisfied by setting the relationship between Rv and Rs to Rv>Rs and adjusting Rv and Rs to the values indicated in Table 1.

In this embodiment, for the same reason as in the second comparative example, the primary transfer performance may be satisfied by setting Rs lower than Rv. In fact, the results in Table 2 indicate that the potentials of the intermediate transfer belt 10 at up to the fourth image forming station d may be substantially uniformly maintained.

As for the secondary transfer performance, for the same reason as in the first comparative example, satisfactory secondary transfer may be performed because Rv is set higher than Rs. A current may be passed to the toner portion even with the recording material P being low in resistance, and the evaluation of an actual image is also satisfactory.

As described above, in this embodiment, in the structure in which a current is supplied to the image carriers through the intermediate transfer belt 10 when primary transfer is performed, the primary transfer performance and the secondary transfer performance may be satisfied together by setting the relationship between Rv and Rs to Rv>Rs, where Rv and Rs are respectively the resistance in the thickness direction and the resistance in the circumferential direction of the intermediate transfer belt 10.

Figure 6:
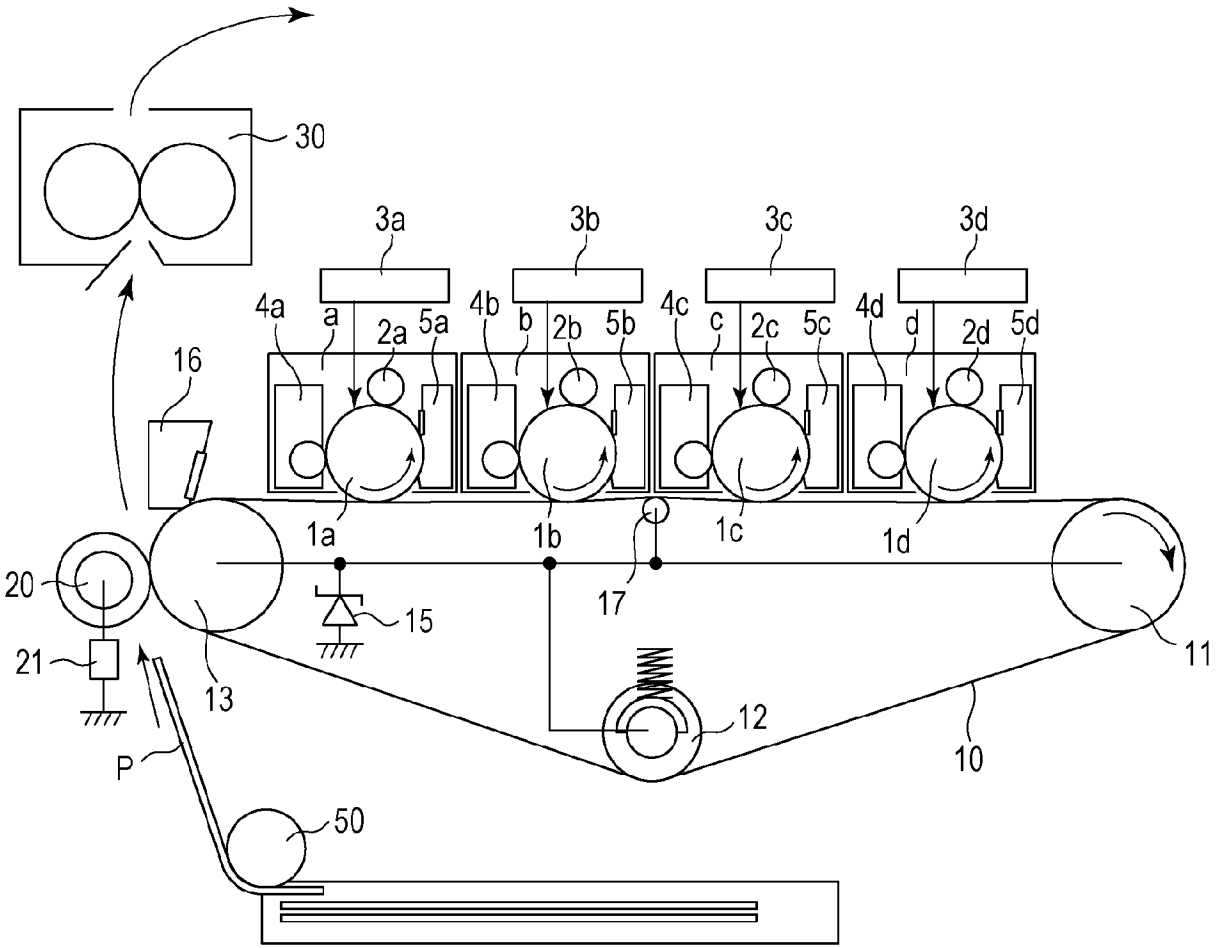
FIG. 6 is a schematic view illustrating a different image forming apparatus according to the first embodiment.

This embodiment is applicable to an image forming apparatus illustrated in FIG. 6. As illustrated in FIG. 6, there is provided a contact member 17 that comes into contact with the intermediate transfer belt 10 within a region corresponding to a primary transfer surface formed on the intermediate transfer belt 10 between the secondary transfer opposite roller 13 and the driving roller 11. A feature of this image forming apparatus is that the voltage-maintaining element 15 is connected to this contact member 17.

Figure 7A:
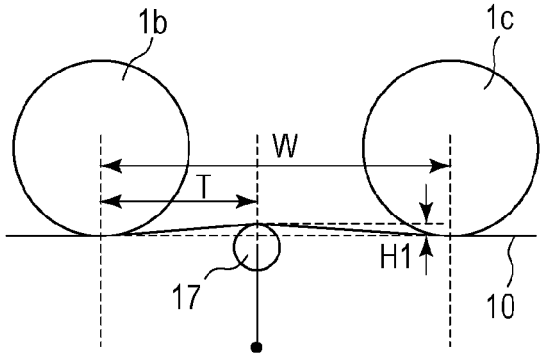
FIGS. 7A and 7B each illustrate the structure of primary transfer portions in the different image forming apparatus according to the first embodiment.

As illustrated in FIG. 6, a metal roller 17, which is the contact member, is arranged at a position between the second image forming station b and the third image forming station c with the intermediate transfer belt 10 interposed between the metal roller 17 and that position. This metal roller 17 enables an amount by which the intermediate transfer belt 10 wraps around the photosensitive drums 1*b* and 1*c* to be ensured at the mid-point position between the second image forming station b and the third image forming station c. As illustrated in FIG. 7A, the metal roller 17 is arranged at a height of 2 mm with respect to a horizontal plane formed by the photosensitive drums 1*b* and 1*c* and the intermediate transfer belt 10. The metal roller 17 is made of a nickel-plated SUS rod having an outside diameter of 6 mm and a straight shape. The metal roller 17 is driven to rotate as the intermediate transfer belt 10 rotates.

The distance between the photosensitive drum 1*b* of the second image forming station b and the photosensitive drum 1*c* of the third image forming station c is denoted W, the distance between each of the photosensitive drums 1*b* and 1*c* and the metal roller 17 is denoted T, and the height by which the metal roller 17 is lifted with respect to the intermediate transfer belt 10 is denoted H1. In this embodiment, W=60 mm, T=30 mm, and H1=2 mm.

Figure 7B:
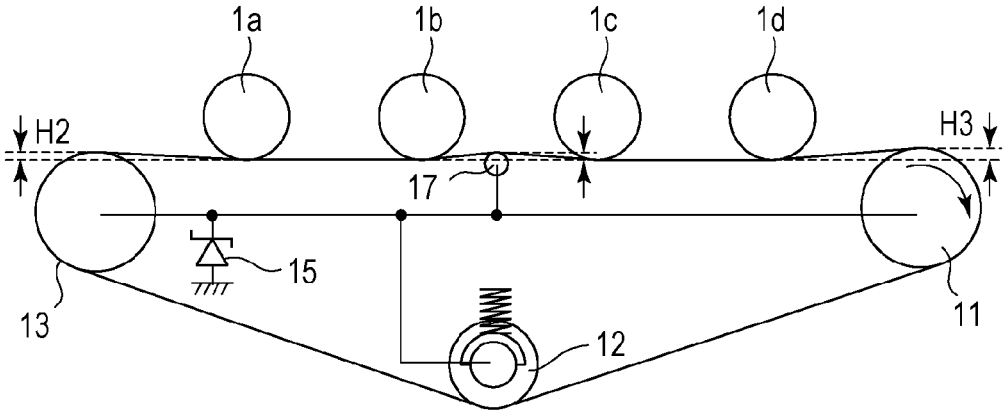

In this embodiment, in order to ensure an amount by which the intermediate transfer belt 10 wraps around the photosensitive drums 1*a* and 1*d*, as illustrated in FIG. 7B, the stretching rollers 11 and 13 are kept lifted 2 mm with respect to a horizontal plane formed by the photosensitive drums 1*a*, 1*b*, 1*c*, and 1*d* and the intermediate transfer belt 10. In the case where heights by which the stretching roller 13 and the stretching roller 11 are lifted with respect to the intermediate transfer belt 10 are respectively H2 and H3, H2=H3=2 mm.

The metal roller 17 connected to the voltage-maintaining element 15 is arranged between the second and third image forming stations, thereby facilitating maintenance of the potential of each primary transfer portion at a desired potential or higher. Hence, the range of usable belt resistance may also be increased.

The structure according to this embodiment has the effect of suppressing a potential drop even when distances between the image forming stations are long. The stretching rollers 11, 12, and 13, and the metal roller 17 are connected with the voltage-maintaining element 15, and suppression of a voltage drop may thereby be performed from the metal roller as well. Thus, a more satisfactory primary transfer may be performed.

Figure 8:
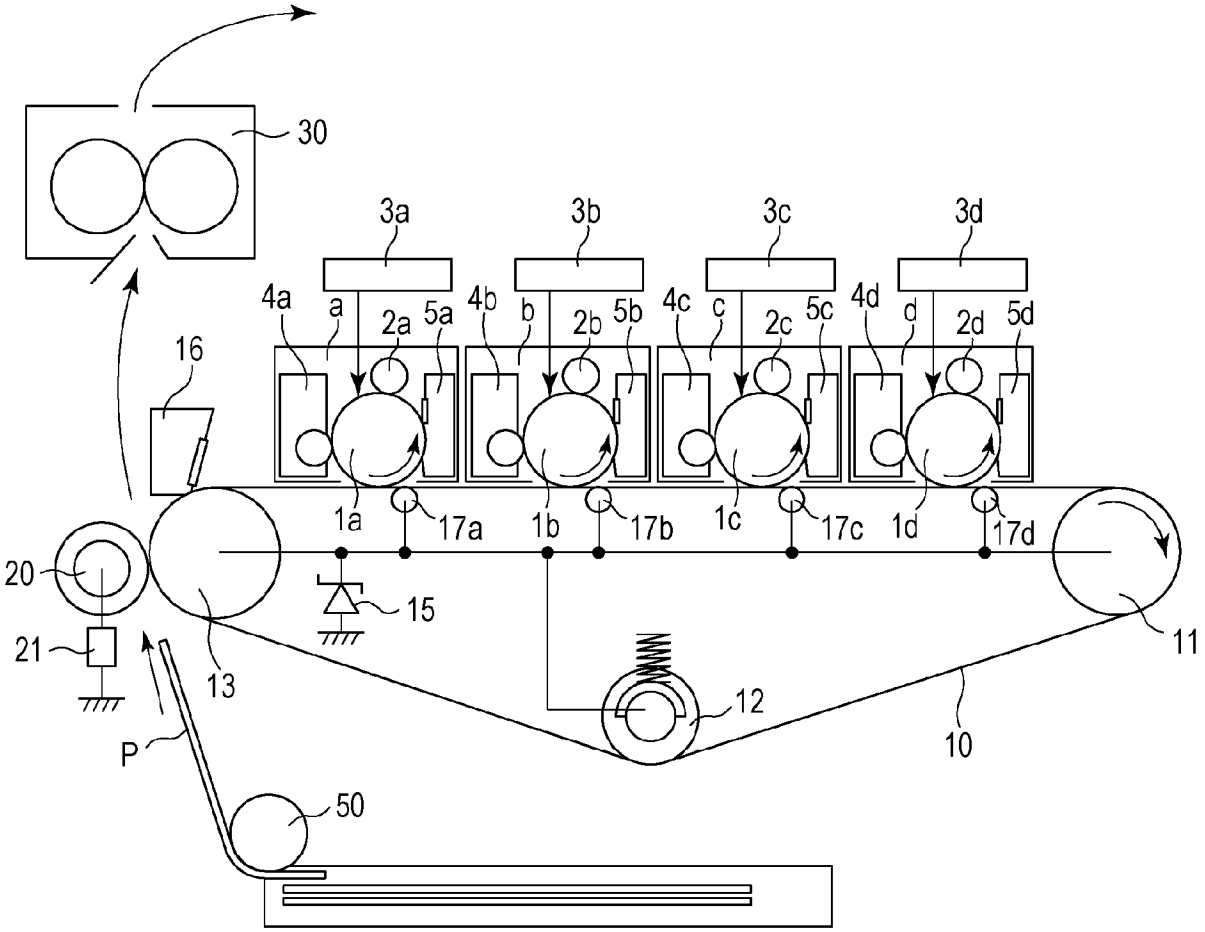
FIG. 8 illustrates the structure of primary transfer portions in a different image forming apparatus according to the first embodiment.
Figure 10:
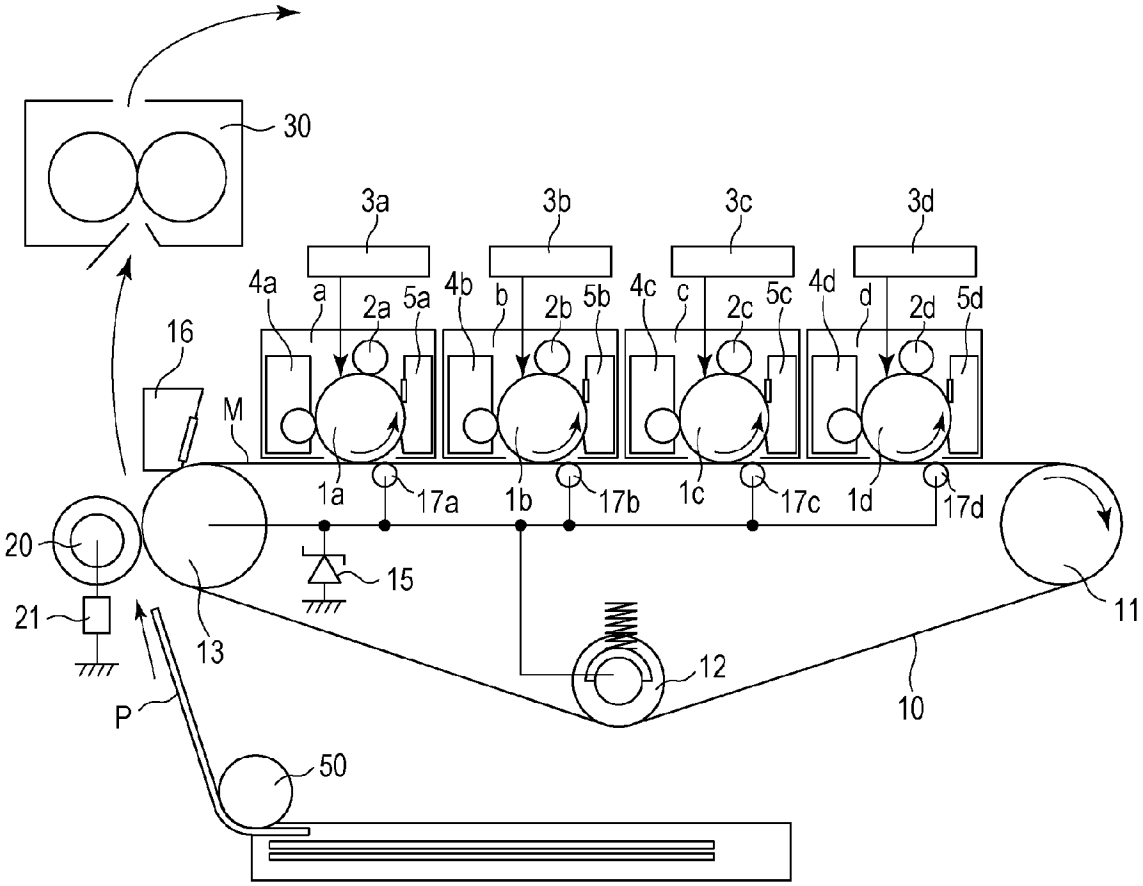
FIG. 10 is a schematic view illustrating another structure according to the first embodiment.

In FIGS. 6, 7A, and 7B, although one metal roller 17 is arranged between the second and third image forming stations disposed between the stretching rollers 11 and 13, as illustrated in FIG. 8, metal rollers 17*a*, 17*b*, 17*c*, and 17*d* corresponding to the respective image forming stations may be arranged. The distance from each photosensitive drum 1 to each metal roller 17 connected to the voltage-maintaining element 15 is small, thereby more facilitating maintenance of the potential of each primary transfer portion at a desired potential or higher. In addition, as illustrated in FIG. 10, in the case where a plurality of contact members (metal rollers 17*a*, 17*b*, 17*c*, and 17*d*) to which the voltage-maintaining element 15 is connected are arranged, the voltage-maintaining element 15 does not have to be connected to 11 serving as the stretching member.

Second Embodiment

In the first embodiment, in order to satisfy both primary transfer performance and secondary transfer performance, a structure is described in which the relationship between Rv and Rs is Rv>Rs, where Rv and Rs are respectively the resistance in the thickness direction and the resistance in the circumferential direction of the intermediate transfer belt 10. Here, the resistance Rs in the circumferential direction in the first embodiment is resistance in the circumferential direction over the distance between the photosensitive drum located most upstream and the photosensitive drum located most downstream in the movement direction of the intermediate transfer belt 10.

On the other hand, in this embodiment, the intermediate transfer belt 10 includes a conductive base layer and an insulating surface layer. Except for the above, the structure is the same as that of the image forming apparatus according to the first embodiment, and portions the same as those in the first embodiment are therefore denoted by the same reference numerals and described.

In the intermediate transfer belt 10 according to this embodiment, as in the first embodiment, a polyphenylene sulfide (PPS) resin which has a thickness of 100 μm and in which carbon is dispersed so as to adjust electric resistance is used as a base layer (conductive base layer). The belt is used in which a surface coat layer (surface layer) which has a thickness of 0.5 to 3 μm and which is made of insulating acrylic resin is additionally provided on the surface (outside of the belt). The surface layer, which is a high-resistance layer, is designed to decrease a difference in current between a paper passing region and a paper non-passing region in the longitudinal direction of a secondary transfer portion.

Next, a method of fabricating the intermediate transfer belt 10 will be described. The fabricating method using an inflation molding method is used. Ingredients, such as PPS serving as a base material and carbon black, which is conductive powder, are fused and kneaded by a twin-screw kneading machine. The obtained kneaded material is extruded through a ring-shaped die, so that the belt is fabricated.

A spray coating of an ultraviolet curable resin is applied onto the surface of the formed endless belt, and the surface is dried and then cured by ultraviolet irradiation, so that the surface coat layer is formed. Because an excessively thick coat layer becomes fragile, the amount of coating is adjusted so as to fall within the range of 0.5 to 3 μm.

As conductive powder, carbon black is used. Additives which are mixed so as to adjust an electric resistance value of the intermediate transfer belt 10 are not particularly limited. Examples of a conductive filler which adjusts the resistance include carbon black and various conductive metal oxides. Examples of a non-filler type resistance adjusting agent include low-molecular-weight ion conducting materials, such as various metal salts and glycols, antistatic resins containing an ether linkage, a hydroxyl group, or the like in the molecule, and organic high polymers exhibiting electronic conductivity.

When the amount of carbon which is added is increased, the resistance of the belt is lowered; however, when the amount of carbon is excessively increased, the strength of the belt itself becomes insufficient and becomes fragile. In this embodiment, the resistance of the belt is lowered within a range in which the belt strength falls within a range in which it is usable in the image forming apparatus.

The intermediate transfer belt 10 according to this embodiment has a Young's modulus of about 3000 MPa. The measurement of the Young's modulus is made in conformity with the tensile elasticity measuring method of JIS-K7127, and the thickness of the measurement sample is 100 μm.

Table 4 indicates belts which vary in the relative ratio of a carbon content to a base.

TABLE 4

| | Carbon Content (relative ratio) | Coat Layer |
|---|---|---|
| Comparative Example Belt | 0.5 | Absence |
| Belt A | 1 | Presence |
| Belt B | 1.5 | Presence |
| Belt C | 2 | Presence |
| Belt D | 1.5 | Absence |
| Belt E | 2 | Absence |

Table 4 indicates an added carbon content and the presence or absence of a surface coat layer. For example, Table 4 indicates that a belt B is 1.5 times the carbon content of a belt A, and a belt C is 2 times the carbon content of the belt A. The belt A, belt B, and belt C each have the surface layer, and a belt D and a belt E are each a single layer belt. The belt B and the belt D are the same in terms of the relative ratio of the carbon content, and the belt C and the belt E are also the same in terms of the relative ratio of the carbon content.

As a comparative example belt, a comparative example belt made of polyimide whose resistance is adjusted by changing the relative ratio of the carbon content is fabricated. In the comparative example belt, the relative ratio of the carbon content is 0.5 and the volume resistivity is $10^{10}$ to $10^{11}$ Ωcm. As a belt employed as the intermediate transfer belt 10, this comparative example belt has a typical resistance value.

Measurements of the volume resistivities and the surface resistivities of the comparative example belt and the belts A to E are indicated below.

First, the above-described comparative example belt and belts A to E were subjected to measurement using a resistivity meter, Hiresta UP (MCP-HT450), manufactured by Mitsubishi Chemical Analytech Co., Ltd. Table 5 indicates the measured volume resistivities and surface resistivities (outer surfaces of the belts). The measuring method conforms to JIS-K6911. Conductive rubber was used as an electrode, a satisfactory contact between the electrode and the surface of the belt was thereby obtained, and then a measurement was made. Measurement conditions are that an application time period be 30 seconds and applied voltages be 10 V and 100 V.

TABLE 5

| | Volume Resistivity [Ωcm] | | Surface Resistivity [Ω/□] | |
|---|---|---|---|---|
| Applied Voltage | 10 v | 100 v | 10 v | 100 v |
| Comparative Example Belt | over | $1.0 \times 10^{10}$ | over | $1.0 \times 10^{10}$ |
| Belt A | over | $2.0 \times 10^{12}$ | over | $1.0 \times 10^{12}$ |
| Belt B | $1.0 \times 10^{12}$ | under | $4.0 \times 10^{11}$ | $2.0 \times 10^{8}$ |
| Belt C | $1.0 \times 10^{10}$ | under | $5.0 \times 10^{10}$ | under |
| Belt D | $5.0 \times 10^{6}$ | under | $5.0 \times 10^{6}$ | under |
| Belt E | under | under | under | under |

In the comparative example belt, when a voltage of 100 V is applied, the volume resistivity is $1.0\times10^{10}$ Ωcm and the surface resistivity is $1.0\times10^{10}$Ω/□. However, in the comparative example belt, when a voltage of 10 V is applied, the flowing current is excessively small, and the volume resistivity is unmeasurable, and thus "over" is indicated.

On the other hand, in each of the belts B, C, and D, in the case of the application of 100 V, the value of the flowing current is excessively large because the resistance of the belt is low, and thus "under" representing unmeasurable volume resistivity is indicated. In the case of the application of 100 V, in the belt B, the surface resistivity is $2.0\times10^{8}$Ω/□; however, in each of the belts C and D, the surface resistivity is indicated as "under".

In Table 5, in the case of an applied voltage of 10 V, the volume resistivity and the surface resistivity of the belt A are unmeasurable. Comparison of the belt A and the comparative example belt in the case of the application of 100 V indicates that the belt A is higher than the comparative example belt in terms of the surface resistivity. This is due to the influence of the coat layer. It is found that the belt A with a high-resistance surface layer coating is higher than the comparative example belt without a surface layer coating in terms of resistance.

Comparison of the belt B and the belt D and comparison of the belt C and the belt E indicate that the coat layer increases the resistance value. Comparison of the belt B and the belt C and comparison of the belt D and the belt E indicate that an increase in the carbon content lowers the resistance value. In the belt E, the resistance is excessively low, so that all the items are unmeasurable.

Figure 11A:
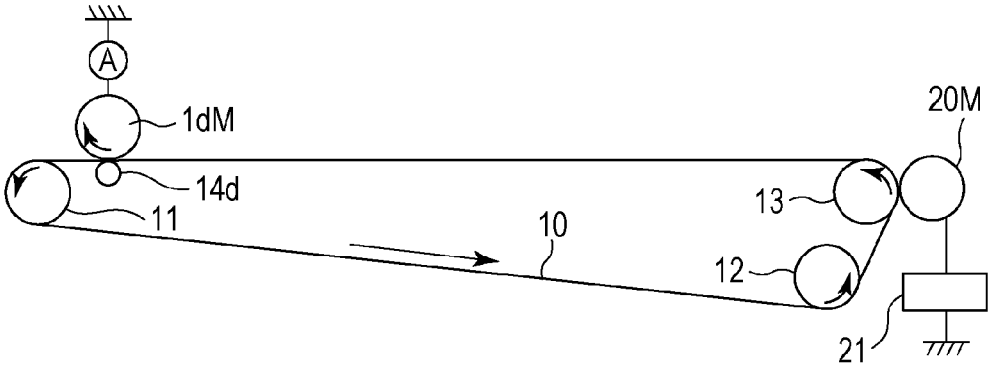
FIGS. 11A and 11B are schematic views each illustrating a method for measuring resistance in the circumferential direction of an intermediate transfer belt.

In the second embodiment, the intermediate transfer belt of the range indicated as "under" in Table 5 has to be used. In this embodiment as well, resistance in the circumferential direction of the belt is important as in the first embodiment. In this embodiment, the resistance value of a belt whose resistance is low is measured by using a method illustrated in FIGS. 11A and 11B. In FIG. 11A, when a constant voltage (measurement voltage) is applied from a measurement power supply (the transfer power supply 21 is used herein) to an outer roller 20M (first metal roller), a current flowing to an ammeter, which is a current detection unit, connected to a photosensitive drum 1*d*M (second metal roller) of the image forming station d is detected. A method in which electric resistance of the intermediate transfer belt 10 between the contact position of the outer roller 20M and the contact position of the photosensitive drum 1*d*M is determined by using the detected current value is used.

Figure 11B:
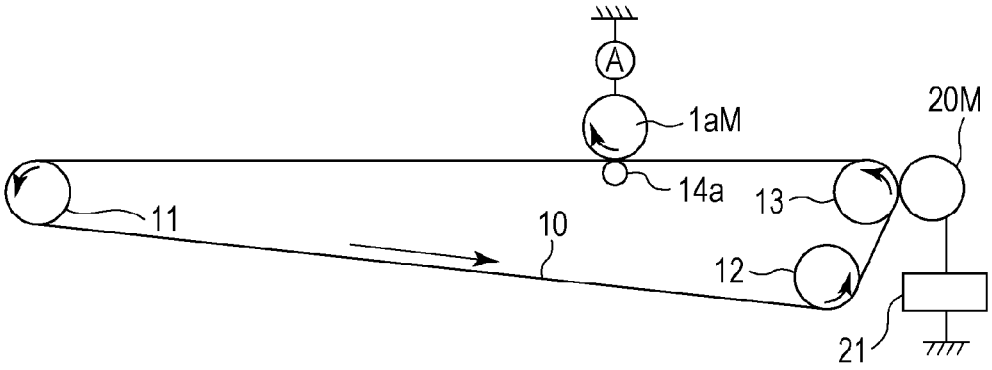

A current flowing in the circumferential direction (rotation direction) of the intermediate transfer belt 10 is measured by using this method, and the resistance of the belt is calculated by dividing the measurement voltage by the measured current value. At this time, in order to eliminate the influence of resistance other than that of the intermediate transfer belt, the outer roller 20M and the photosensitive drum 1*d*M which are made of only metal (aluminum) are used, and a mark "M" (Metal) is added to the reference numerals so as to indicate the metal rollers. In this embodiment, the distance between a contact portion of the outer roller 20M and the photosensitive drum 1*d*M is 370 mm along the upper surface side of the intermediate transfer belt and 420 mm along the lower surface side of the intermediate transfer belt. FIG. 11B is different from FIG. 11A in terms of making a measurement with a second metal roller arranged in the image forming station a (the position of the ammeter is different from that in FIG. 11A).

Figure 12A:
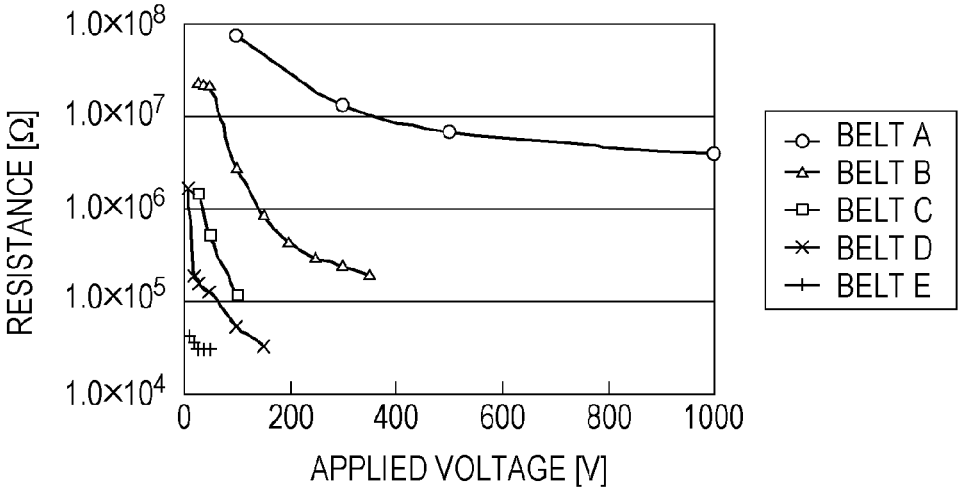
FIGS. 12A and 12B illustrate measurements of resistance and current in the circumferential direction of intermediate transfer belts.

By using the above measuring method, an applied voltage was changed and measurements of the belts A to E were made. The measured results are illustrated in FIG. 12A. In this measuring method, because the resistance in the circumferential direction of the intermediate transfer belt 10 is measured, it is referred to as circumferential-direction resistance. In all the belts, as an applied voltage is increased, the resistance tends to decrease gradually. This is a feature of the belt formed by dispersing carbon in a resin. Even when the distance between the secondary transfer portion and the ammeter is changed as in FIG. 11B, measurements are substantially the same as those in FIG. 12A.

Figure 12B:
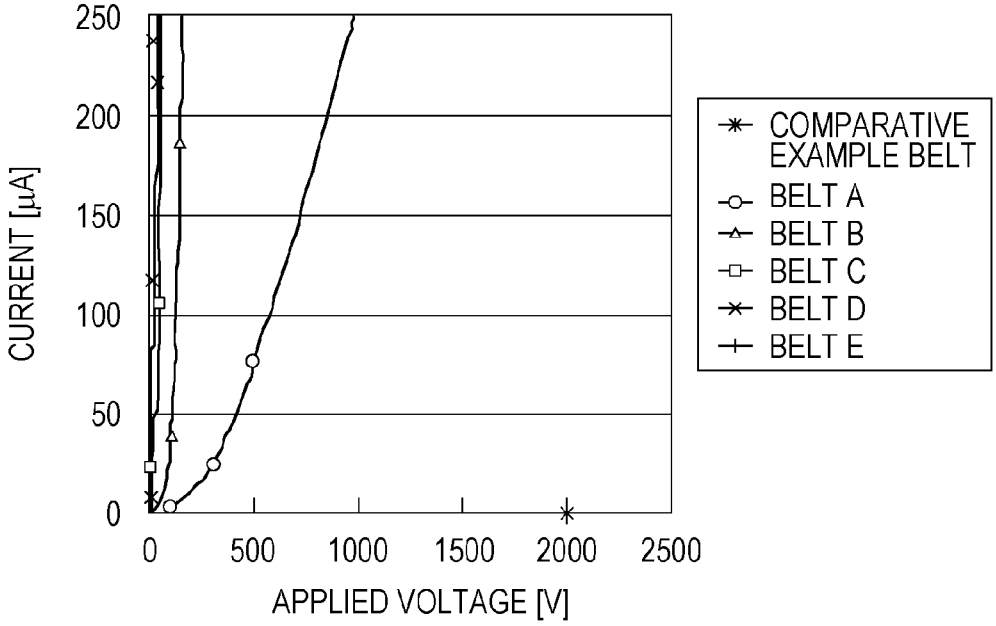

FIG. 12B illustrates a graph on which currents measured by using the measuring method illustrated in FIGS. 11A and 11B are directly plotted. The vertical axis (resistance [Ω]) in the above-described FIG. 12A represents value obtained by a measured current value in FIG. 12B being converted by dividing the current value by an applied voltage.

As illustrated in FIG. 12B, in the comparative example belt, a current did not flow in the circumferential direction even when a voltage of 2000 V was applied. However, as illustrated in FIG. 12B, it is found that, in the belts A to E, a current of 50 μA or more flows at a voltage of 500 V or less. In this embodiment, the belt used as the intermediate transfer belt 10 had a circumferential-direction resistance of $10^4$ to $10^8$Ω. As long as the circumferential-direction resistance was $10^4$ to $10^8$Ω, the image forming apparatus according to this embodiment facilitated the flow of current in the circumferential direction of the belt and provided a satisfactory result to ensure desired primary transfer performance.

Figure 13:
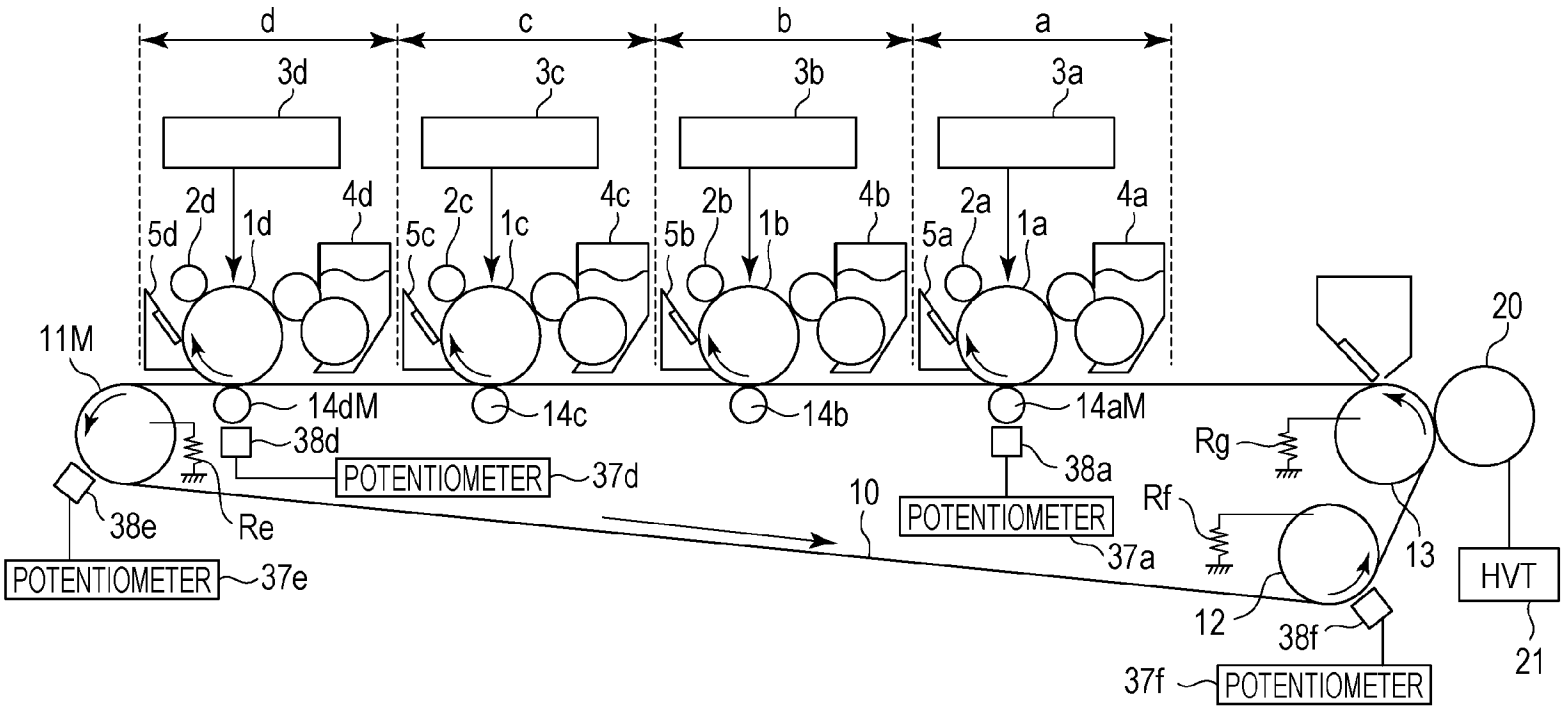
FIG. 13 illustrates a method for measuring a potential of the intermediate transfer belt.

Next, a belt surface potential of the intermediate transfer belt 10 whose circumferential-direction resistance is $10^4$ to $10^8$Ω will be described. FIG. 13 illustrates a method for measuring a belt surface potential. In the drawing, potentials at four portions are measured with four surface potentiometers. 14*d*M and 14*a*M in the drawing denote metal rollers for measurement.

A surface potentiometer 37*a* and a measuring probe 38*a* measure a potential of a primary transfer roller 14*a*M (metal roller) of the image forming station a. As a measuring device, a surface potentiometer MODEL 344 manufactured by TREK Japan Co., Ltd. is used. Because the metal roller has the same potential as that of the inner surface of the intermediate transfer belt, an inner surface potential of the intermediate transfer belt may be measured by using the present method. Similarly, a surface potentiometer 37*d* and a measuring probe 38*d* measure an inner surface potential of the intermediate transfer belt by using a potential of a primary transfer roller 14*d*M (metal roller) of the image forming station d.

A surface potentiometer 37*e* and a measuring probe 38*e* face a driving roller 11M and measure an outer surface potential of the intermediate transfer belt, and a surface potentiometer 37*f* and a measuring probe 38*f* face the tension roller 12 and measure an outer surface potential of the intermediate transfer belt. The driving roller 11M, the secondary transfer opposite roller 13, and the tension roller 12 are respectively connected to Re, Rg, and Rf, which are electric resistors.

As a result of measuring potentials of the intermediate transfer belt by using the present measuring method, it was found that there was almost no difference due to measured portions and the belt potentials were almost the same inside the intermediate transfer belt. That is, the belt used in this embodiment may be considered to have not only a certain level of resistance value but also conductivity.

Figure 14A:
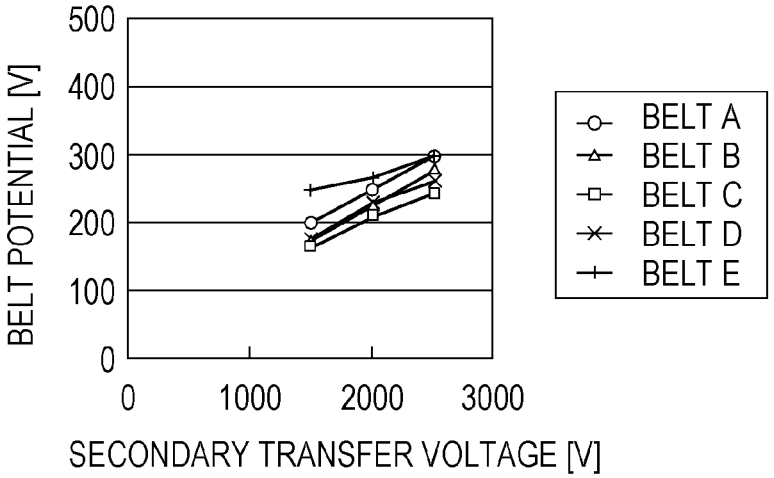
FIGS. 14A to 14C illustrate measurements of potentials of the intermediate transfer belts.
Figure 14B:
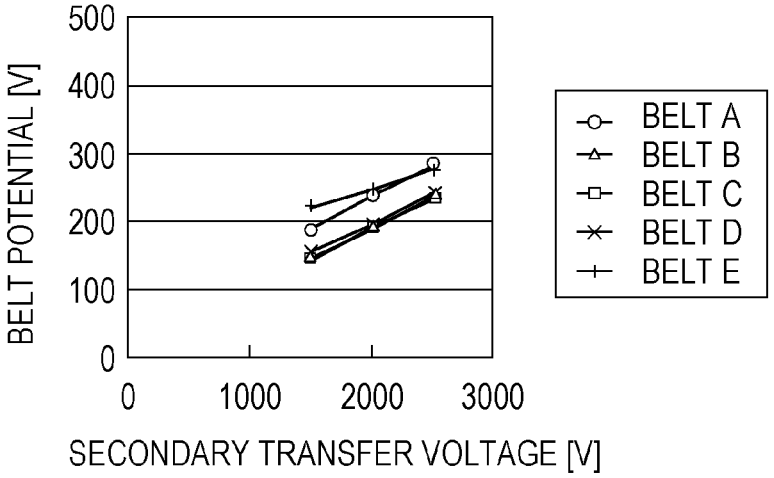
Figure 14C:
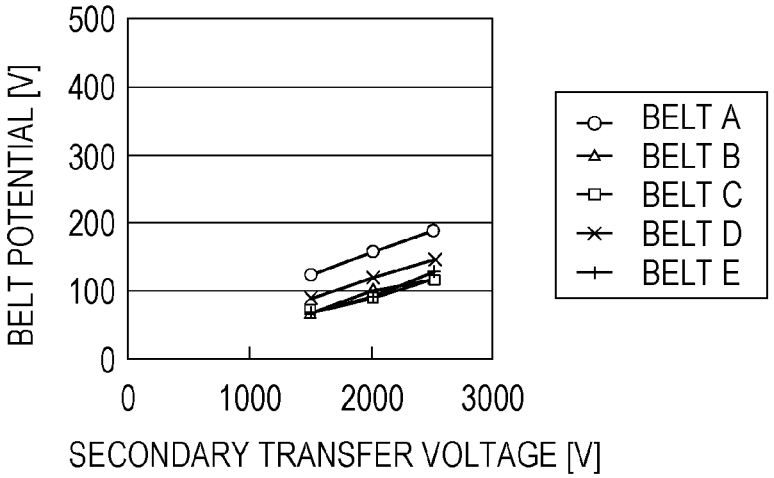

FIGS. 14A to 14C illustrate measurements of intermediate transfer belt potentials. FIG. 14A illustrates measurements in the case where 1 GΩ resistors Re, Rf, and Rg were used. The horizontal axis represents the voltage applied to the transfer power supply 21 for transfer, the vertical axis represents the potential of the intermediate transfer belt, and measurements in the belts A to E are illustrated.

Similarly, FIG. 14B illustrates measurements in the case of the 100 MΩ resistors Re, Rf, and Rg, and FIG. 14C illustrates measurements in the case of the 10 MΩ resistors Re, Rf, and Rg.

In any of the belts, as an applied voltage is increased, a belt surface potential also increases. As a resistance value is reduced from 1 GΩ to 100 MΩ and 10 MΩ, the belt surface potential decreases. Here, although all of the resistance values of Re, Rf, and Rg are the same, it is found that, when any one of the resistance values is reduced, the belt surface potential decreases in response to the resistance.

In an intermediate transfer belt having a resistance value at which a current flows with difficulty in the circumferential direction as in the comparative example belt, a belt surface potential may not be able to be measured by using the above-described method. The reasons are as follows. In a structure in which a voltage is applied to each primary transfer roller by a dedicated power supply 9, a potential measuring probe may not be able to be arranged. In addition, because potentials at positions in the belt circumferential direction are different, even when the potential measuring probe is arranged opposite a support roller and a measurement is made, the belt surface potential at the primary transfer portion may not be able to be measured.

Figure 15:
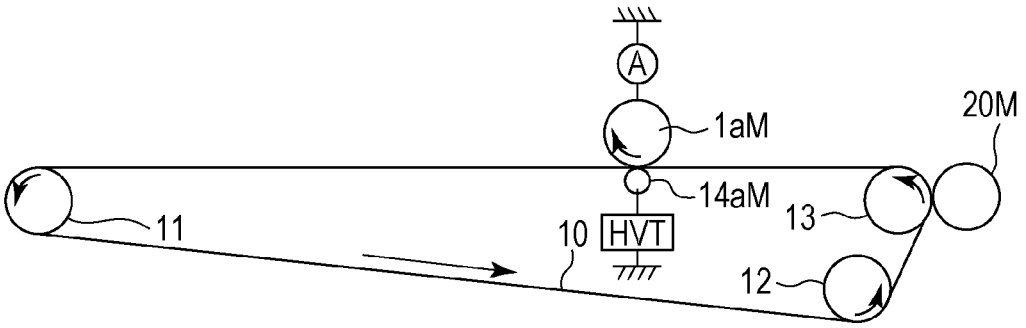
FIG. 15 is a schematic view illustrating a method for measuring resistance in the thickness direction of the intermediate transfer belt.

Next, measurement of resistance in a belt thickness direction using a similar method will be described. As illustrated in FIG. 15, a voltage is applied from a measurement power supply to the primary transfer roller 14*a*M (third metal roller). Then, a method in which the current flowing to an ammeter connected to a photosensitive drum 1*a*M (fourth metal roller) of the image forming station a is detected and electric resistance of the intermediate transfer belt 10 between the primary transfer roller 14*a*M and the photosensitive drum 1*a*M is determined is used.

Figure 16A:
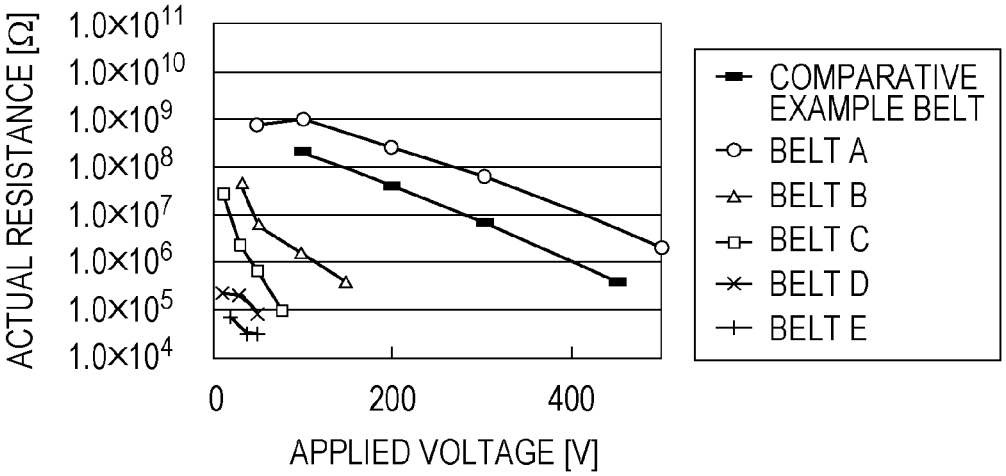
FIGS. 16A and 16B illustrate measurements of resistance in the thickness direction of the intermediate transfer belts.
Figure 16B:
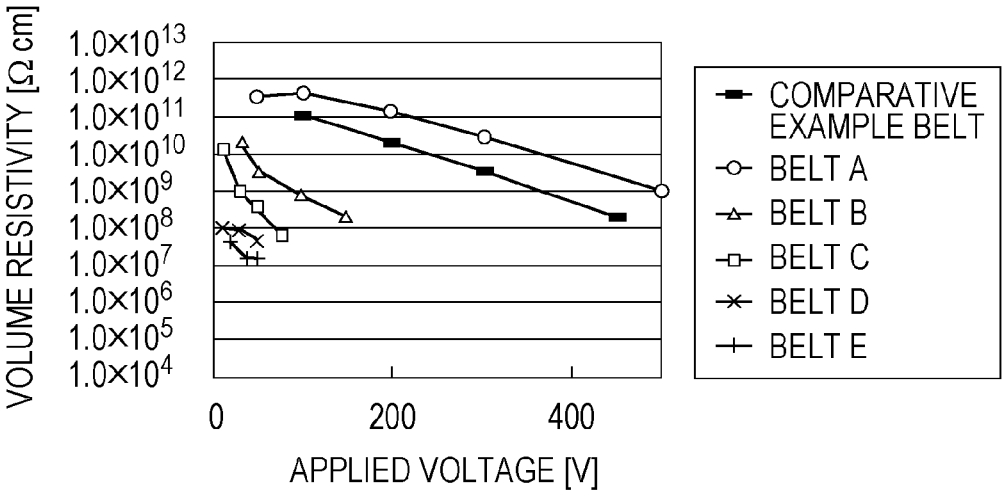

At this time, in order to eliminate the influence of resistance other than that of the intermediate transfer belt, the primary transfer roller 14*a*M and the photosensitive drum 1*a*M which are made of only metal are used, and a mark "M" (Metal) is added to the reference numerals so as to indicate the metal rollers. In this embodiment, the nip width formed by the primary transfer portion and the photosensitive drum 1*a*M in the belt conveyance direction is 2 mm, and the nip width in the direction perpendicular to the belt conveyance direction is 220 mm. FIGS. 16A and 16B illustrate measurements of resistance. FIG. 16A illustrates actual resistance values measured by using the measuring method illustrated in FIG. 15, and FIG. 16B illustrates measurements converted into volume resistivities. Thus, as for the resistance in the thickness direction of the existing belt and the belts A to E, the actual resistance values are $10^4$ to $10^9$Ω and the volume resistivities are $10^7$ to $10^{12}$ Ωcm.

Hence, the intermediate transfer belt 10 according to this embodiment has the insulating surface layer, so that the resistance in the circumferential direction is $10^4$Ω or more and $10^8$Ω or less, and the resistance in the thickness direction is $10^4$Ω or more and $10^9$Ω or less. Because the relationship in which the resistance in the thickness direction is larger than the resistance in the circumferential direction is satisfied, secondary transfer performance may be ensured while primary transfer performance is ensured, as in the first embodiment.

Figure 17:
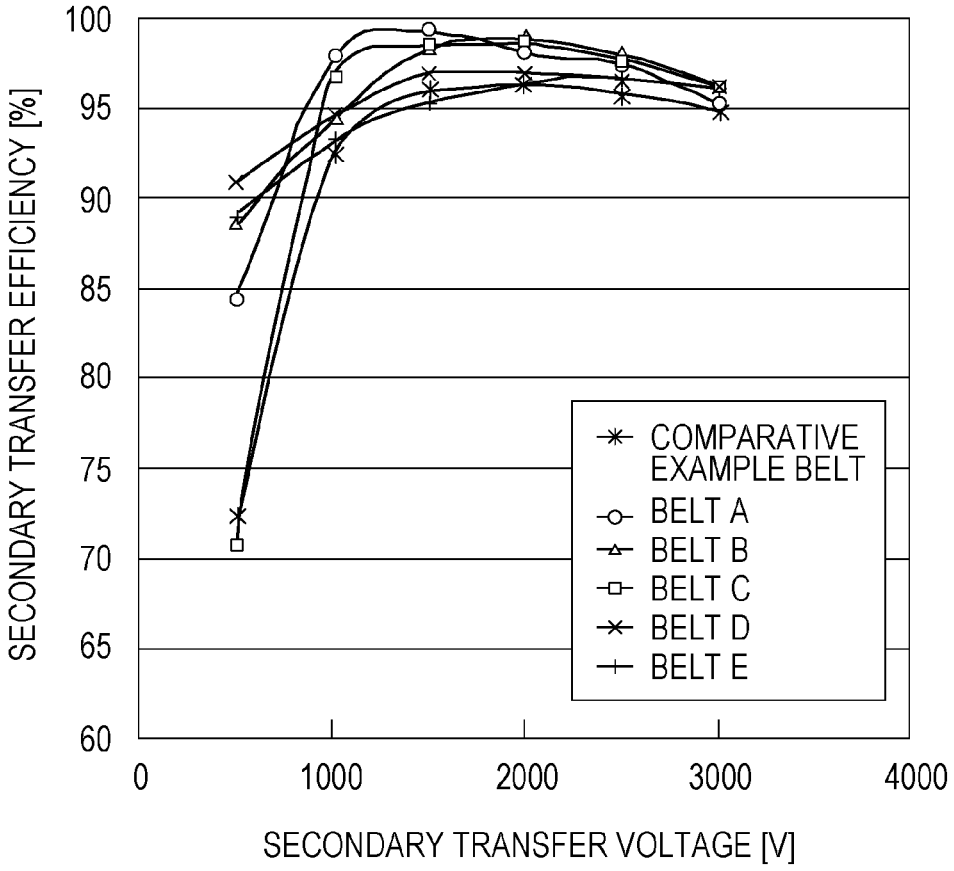
FIG. 17 illustrates results of secondary transfer efficiency in a second embodiment.

FIG. 17 is a graph illustrating secondary transfer efficiency. The secondary transfer efficiency is an index of the secondary transfer performance indicating what percentage of toner primary-transferred onto the intermediate transfer belt has been transferred onto the recording material. Generally, when the secondary transfer efficiency is 95% or more, it is determined that transfer is completed with no trouble. An image formed in order to measure the secondary transfer efficiency is a two-color solid image having a width of 10 mm. The reason why this image is selected is because this image brings about conditions under which, in view of the longitudinal direction of the secondary transfer portion, a secondary transfer current difference between a toner portion and a non-toner portion in the longitudinal direction becomes large and it is difficult to ensure the secondary transfer performance.

Figure 18A:
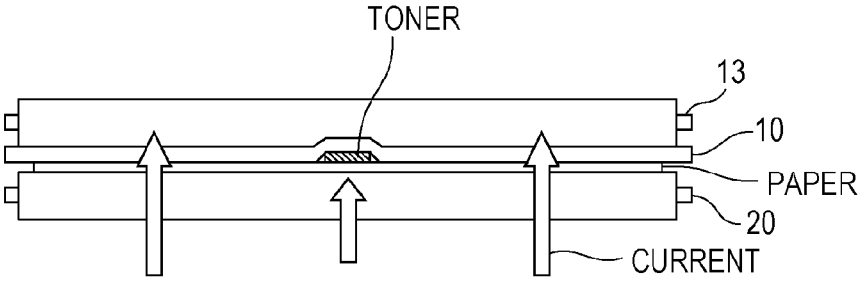
FIGS. 18A to 18D illustrate effects of the intermediate transfer belt according to the second embodiment.

A secondary transfer current difference in the longitudinal direction may be decreased by providing the insulating surface layer. Effects of the insulating surface layer will be described using FIGS. 18A to 18D. FIGS. 18A to 18D each illustrate a longitudinal cross section of the secondary transfer portion. FIG. 18A illustrates secondary transfer of an image having a width of 10 mm onto normal-size paper using a single layer intermediate transfer belt. An up arrow denotes a secondary transfer current and the length of the arrow indicates the amount of current. A long arrow indicates that the amount of current is large. Here, the amount of current at a toner portion is small and the amount of current at a non-toner portion is large.

Figure 18B:
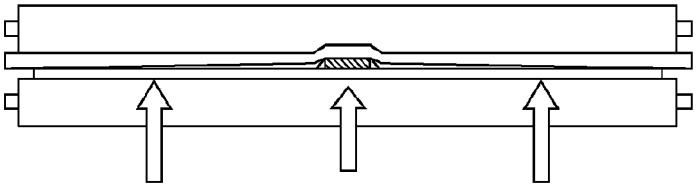

FIG. 18B illustrates secondary transfer of an image having a width of 10 mm onto normal-size paper using a two-layer intermediate transfer belt. In the case of the two-layer intermediate transfer belt, it is found that the secondary transfer current difference between a toner portion and a non-toner portion is decreased.

Figure 18C:
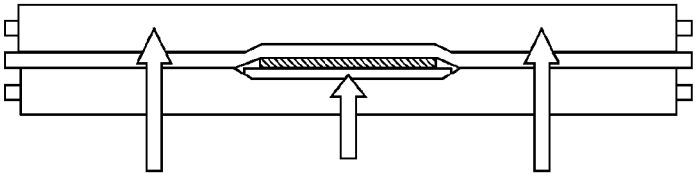
Figure 18D:
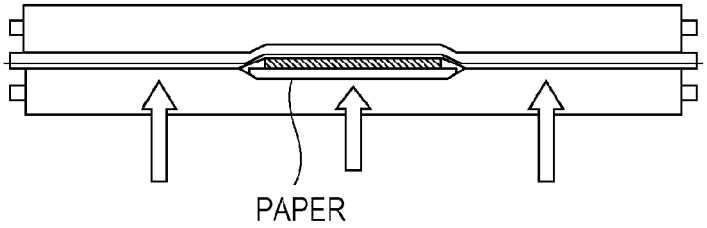

FIG. 18C illustrates secondary transfer of a solid image onto small-size paper using a single layer intermediate transfer belt. It is indicated that the amount of current at a paper portion is small and the amount of current at a non-paper portion is large, as in the case of a toner portion and a non-toner portion. FIG. 18D illustrates secondary transfer of a solid image onto small-size paper using a two-layer intermediate transfer belt. In the case of the two-layer intermediate transfer belt, it is found that the secondary transfer current difference between a paper portion and a non-paper portion is decreased.

As described above, the intermediate transfer belt including two layers, i.e., the conductive base layer and the insulating surface layer, is used, so that the secondary transfer performance may be further improved. That is, even when a difference in current amount in the longitudinal direction of the secondary transfer portion is likely to occur as in the case of a toner portion, a non-toner portion, a paper portion, and a non-paper portion, the use of the surface-coated two-layer intermediate transfer belt may improve the secondary transfer performance.

The present invention may provide an image forming apparatus that ensures satisfactory secondary transfer performance while ensuring satisfactory primary transfer performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

an image carrier which carries toner images;

an endless intermediate transfer belt onto which the toner images are primary-transferred from the image carrier and which is movable and has conductivity;

a secondary transfer member which comes into contact with an outer periphery of the endless intermediate transfer belt and secondary-transfers the toner images from the endless intermediate transfer belt onto a recording material, the image forming apparatus performing primary transfer by a current being passed from the secondary transfer member to the image carrier through the endless intermediate transfer belt;

a transfer power supply which applies a voltage for transfer which has a polarity opposite to a normal charge polarity of toner to the secondary transfer member;

a contact member which comes into contact with an inner periphery of the endless intermediate transfer belt; and a voltage-maintaining element which is connected to the contact member, and maintains a potential of the contact member at a same polarity as the polarity of the voltage for transfer by the current being passed, through the endless intermediate transfer belt, from the secondary transfer member to which the voltage for transfer is applied by the transfer power supply, wherein the endless intermediate transfer belt includes a surface layer and a conductive base layer, and a resistance of the surface layer is higher than a resistance of the conductive base layer.

2. The image forming apparatus according to claim 1, wherein the secondary transfer member is in contact with the surface layer.

3. The image forming apparatus according to claim 1, wherein the contact member is in contact with the conductive base layer.

4. The image forming apparatus according to claim 1, wherein the voltage applied by the transfer power supply to the secondary transfer member is a constant voltage.

5. The image forming apparatus according to claim 1, wherein the voltage-maintaining element is a constant voltage element.

6. The image forming apparatus according to claim 1, wherein the contact member and the secondary transfer member nip the endless intermediate transfer belt therebetween.

7. The image forming apparatus according to claim 1, wherein the contact member faces the image carrier through the endless intermediate transfer belt.

8. The image forming apparatus according to claim 1, wherein the image carrier is plural in number and each of a plurality of image carriers carries toner images of a different color.

9. The image forming apparatus according to claim 1, wherein the contact member is each of a plurality of metal rollers arranged so as to correspond to different one of the plurality of image carriers, and the voltage-maintaining element is connected to each of the plurality of metal rollers.

10. The image forming apparatus according to claim 1, wherein the surface layer is a layer made of insulating acrylic resin.

11. The image forming apparatus according to claim 1, wherein a thickness of the surface layer is less than a thickness of the conductive base layer.

12. The image forming apparatus according to claim 1, wherein the thickness of the surface layer is 0.5 to 3 μm.

13. The image forming apparatus according to claim 1, wherein a relationship between Rv and Rs is such that Rv is larger than Rs, where Rv is resistance in a thickness direction of the endless intermediate transfer belt and Rs is resistance in a circumferential direction of the endless intermediate transfer belt.

14. The image forming apparatus according to claim 1, wherein the voltage-maintaining element maintains the potential of the endless intermediate transfer belt at a certain potential or higher by the current being passed, through the endless intermediate transfer belt, from the secondary transfer member.

* * * * *